US007815184B2

(12) United States Patent
Watanabe et al.

(10) Patent No.: US 7,815,184 B2
(45) Date of Patent: Oct. 19, 2010

(54) PAPER SHEET SEPARATING AND TAKE-OUT DEVICE

(75) Inventors: Tetsuo Watanabe, Machida (JP); Yukio Asari, Yokohama (JP); Yoshihiko Naruoka, Yokohama (JP); Naruaki Hiramitsu, Kawasaki (JP); Yusuke Mitsuya, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 605 days.

(21) Appl. No.: 11/798,241

(22) Filed: May 11, 2007

(65) Prior Publication Data

US 2007/0262512 A1 Nov. 15, 2007

(30) Foreign Application Priority Data

May 11, 2006 (JP) ..... 2006-132823

(51) Int. Cl.
*B65H 3/34* (2006.01)

(52) U.S. Cl. ..... 271/104; 271/93; 271/99; 271/100; 271/103

(58) Field of Classification Search ..... 271/93, 271/99, 100, 103, 104
See application file for complete search history.

(56) References Cited

U.S. PATENT DOCUMENTS 3,198,514 A 8/1965 Barbera et al.
3,260,520 A 7/1966 Sugden
3,599,967 A * 8/1971 Rapparlie et al. ..... 271/12
3,961,784 A * 6/1976 Sevak et al. ..... 271/94
3,976,291 A 8/1976 Bernardi et al.
4,018,434 A * 4/1977 Mitchell et al. ..... 271/96
4,174,102 A * 11/1979 Clausing ..... 271/35
4,269,405 A * 5/1981 Mitzel ..... 271/94
4,324,394 A * 4/1982 Mitzel et al. ..... 271/5
4,359,214 A * 11/1982 Eldridge ..... 271/5
4,494,745 A * 1/1985 Ward et al. ..... 271/95

(Continued)

FOREIGN PATENT DOCUMENTS

EP 0 562 580 9/1993

(Continued)

OTHER PUBLICATIONS

European Search Report dated Dec. 12, 2008 for Appln. No. 07009477.6-1256.

(Continued)

*Primary Examiner*—Saúl J Rodríguez
*Assistant Examiner*—Howard Sanders
(74) *Attorney, Agent, or Firm*—Pillsbury Winthrop Shaw Pittman, LLP

(57) ABSTRACT

A take-out device includes a take-out mechanism which takes out postal matters supplied to a take-out position at one end of a deposit section one by one, a separating mechanism which separates second and subsequent postal matters that are carried along with a postal matter to be taken out from the take-out position, and an auxiliary mechanism which applies a negative pressure to the postal matter on the take-out position so as to feed it in both forward and opposite directions. The separating mechanism applies a negative pressure to the postal matter on the conveyance path via a plurality of adsorption holes of a separating roller so as to adsorb it, and applies a separating torque in an opposite direction to the take-out direction thereto.

3 Claims, 20 Drawing Sheets

U.S. PATENT DOCUMENTS

| | | | | | |
|---|---|---|---|---|---|
| 4,509,735 | A | * | 4/1985 | Kosner | 271/11 |
| 5,074,539 | A | * | 12/1991 | Wells et al. | 271/12 |
| 5,154,407 | A | * | 10/1992 | Shidara | 271/12 |
| 5,290,022 | A | * | 3/1994 | Sabatier et al. | 271/12 |
| 5,295,675 | A | * | 3/1994 | Hain | 271/12 |
| 5,354,045 | A | * | 10/1994 | Boldrini et al. | 271/11 |
| 5,507,479 | A | * | 4/1996 | Martin et al. | 271/11 |
| 5,507,480 | A | * | 4/1996 | Martin et al. | 271/94 |
| 5,520,380 | A | * | 5/1996 | Martin et al. | 271/94 |
| 5,921,540 | A | * | 7/1999 | Acquaviva et al. | 271/98 |
| 6,082,727 | A | * | 7/2000 | Thompson | 271/94 |
| 6,270,069 | B1 | * | 8/2001 | Cera et al. | 271/104 |
| 6,575,450 | B2 | * | 6/2003 | Blackwell et al. | 271/11 |
| 7,108,258 | B2 | * | 9/2006 | Groegor et al. | 271/108 |
| 7,172,116 | B2 | * | 2/2007 | Yamamiya | 235/381 |
| 7,628,393 | B2 | * | 12/2009 | Mitsuya et al. | 271/10.01 |
| 2002/0011703 | A1 | * | 1/2002 | Tomiyama et al. | 271/12 |

FOREIGN PATENT DOCUMENTS

| | | | |
|---|---|---|---|
| EP | 0 589 789 | B1 | 5/1997 |
| EP | 0 645 330 | B1 | 2/1998 |
| EP | 1 837 296 | A2 | 9/2007 |
| JP | 07-053103 | | 2/1995 |
| JP | 08-188279 | | 7/1996 |
| JP | 10-231040 | | 9/1998 |
| JP | 2003-341860 | | 12/2003 |
| KR | 10-0338061 | | 10/2002 |

OTHER PUBLICATIONS

Korean Office Action dated Aug. 11, 2008 for Appln. No. 10-2007-45351.

* cited by examiner

PAPER SHEET SEPARATING AND TAKE-OUT DEVICE

CROSS-REFERENCE TO RELATED APPLICATIONS

This application is based upon and claims the benefit of priority from prior Japanese Patent Application No. 2006-132823, filed May 11, 2006, the entire contents of which are incorporated herein by reference.

BACKGROUND OF THE INVENTION

1. Field of the Invention

The present invention relates to a paper sheet separating and take-out device which separates and takes out paper sheets in an accumulated state one by one.

2. Description of the Related Art

Conventionally, as a take-out device that takes out a plurality of paper sheets in an accumulated state one by one, there is known a device that causes a take-out roller to contact with a paper sheet in one end of an accumulating direction to rotate the roller and takes out the paper sheet in a direction substantially perpendicular to the accumulating direction (see, for example, Jpn. Pat. Appln. KOKAI Publication No. 2003-341860). The device is incorporated into, for example, postal matter processing devices that inspect and sort a plurality of postal matters.

The take-out device includes a separating mechanism that separates second and subsequent paper sheets that are carried along with a paper sheet taken out by the take-out roller. The separating mechanism has a feed roller and a separating roller. The feed roller takes out a paper sheet to be taken out on the same side as the take-out roller and is arranged on a downstream side of the take-out roller. The separating roller is arranged across the taken-out paper sheet from the feed roller. A plurality of separating mechanisms are occasionally arranged along a take-out direction of the paper sheets.

The feed roller rotates so as to feed the taken-out paper sheet in a forward direction. On the other hand, the separating roller rotates in conjunction with the feed roller when one paper sheet intervenes or no paper sheet is present between the feed roller and the separating roller. When a plurality of overlapped paper sheets pass between the separating roller and the feed roller, the separating roller applies a separating torque which directs towards a direction opposite to the take-out direction to second and subsequent paper sheets on the side of the separating roller. As a result, the second and subsequent paper sheets are braked so as to be separated from the first paper sheet.

In this kind of the separating mechanism, the feed roller frequently contacts with the separating roller and rotates. The separating mechanism uses rubber rollers having large friction coefficient in order to heighten a separating performance. Therefore, when the rollers contact with each other, they wear over time so that the separating performance is degraded. Particularly, when the take-out speed of the paper sheets is heightened, the abrasion of the rubber rollers progresses, so that its life is noticeably shortened. For this reason, it is difficult for the above conventional device to maintain its initial performance and improve its throughput.

On the other hand, as a device that takes out paper sheets onto a conveyance path, devices that include a negative pressure generating device are known (see, for example, EP0589789B1, EP0645330B1 and Jpn. Pat. Appln. KOKAI Publication No. 10-231040). The negative pressure generating device allows paper sheets to be adsorbed to a belt which contacts with the paper sheets to move in a take-out direction. Further, the negative pressure generating device allows paper sheets to be adsorbed to a belt which moves while applying a negative pressure to the paper sheets through a plurality of holes on the belt.

Particularly, the device disclosed in Jpn. Pat. Appln. KOKAI Publication No. 10-231040 has a plurality of separating rollers arranged into a nested pattern with respect to a delivery belt. The separating rollers have rubber on their outer peripheries and apply a resistance force in a direction opposite to a delivery direction to multiply-fed paper sheets such that the second and subsequent paper sheets that are carried along with the paper sheet adsorbed to and delivered by the delivery belt are separated. The separating rollers have a supporting structure such that the rollers can be oscillated by collision of paper sheets.

When the separating rollers which apply the resistance force to the multiply-fed paper sheets oscillate and leave the conveyance path of the paper sheets, the resistance force cannot be applied to the paper sheets while the separating rollers pop up due to the collision of the paper sheets. As a result, the multiply-fed paper sheet separating ability is degraded.

The separating rollers used in this device are rubber rollers. Therefore, similarly to the separating roller in Jpn. Pat. Appln. KOKAI Publication No. 2003-341860, they wear over time. For this reason, it is difficult for also the device disclosed in Jpn. Pat. Appln. KOKAI Publication No. 10-231040 to maintain its initial performance for a long time and improve its throughput.

As this kind of the device for taking out paper sheets, a device is known that has a separating roller which always rotates in a direction opposite to the take-out direction of paper sheets in a state that it generates a negative pressure on its peripheral surface so as to adsorb the paper sheets is known (see, for example, Jpn. Pat. Appln. KOKAI Publication No. 8-188279). The separating roller has a plurality of holes on its peripheral surface for generating a negative pressure, and returns second and subsequent paper sheets that are carried along with a paper sheet taken out by a feed roller in an opposite direction.

The separating roller, however, is arranged fixedly so as to be opposed to the feed roller for feeding taken-out paper sheets in a forward direction via a constant space. For this reason, when a comparatively thick paper sheet is sent between these rollers, jam easily occurs. Particularly, in the case where a comparatively thin paper sheet is brought together with a comparatively thick paper sheet, the thin paper sheet is potentially bent or damaged when the thin paper sheet is returned in the opposite direction by the separating roller.

BRIEF SUMMARY OF THE INVENTION

It is an object of the present invention to provide a paper sheet separating and take-out device capable of satisfactorily maintaining its initial performance for a long time and heightening its throughput.

It is another object of the present invention to provide a paper sheet separating and take out device capable of separating and taking out overlapped paper sheets one by one securely without causing jam.

In order to achieve the above object, according to an aspect of the present invention, there is provided a paper sheet separating and take-out device, comprising a deposit section in which a plurality of overlapped paper sheets are deposited; a supply mechanism which moves said plurality of deposited paper sheets in an overlapping direction and supplies a paper sheet at a front end of a moving direction to a take-out position at one end of the deposit section; a take-out mechanism which comes in contact with the paper sheet supplied to the take-out position and rotates so as to take out the paper sheet in a direction substantially perpendicular to the overlapping direction; and a separating mechanism which is arranged on a side opposite to the take-out mechanism across a conveyance path for conveying the paper sheets on a downstream side of a take-out direction of the paper sheets by the take-out mechanism, and applies a negative pressure to the paper sheets to be taken out onto the conveyance path and simultaneously applies a separating torque in an opposite direction to the take-out direction so as to separate second and subsequent paper sheets that are carried along with the paper sheet taken out from the take-out position.

According to another aspect of the present invention, there is provided a paper sheet separating and take-out device, comprising a deposit section in which a plurality of overlapped paper sheets are deposited; a supply mechanism which moves said plurality of deposited paper sheets in an overlapping direction so as to supply a paper sheet at a front end of a moving direction to a take-out position at one end of the deposit section; a take-out mechanism which comes in contact with the paper sheet supplied to the take-out position and rotates so as to take out the paper sheet in a direction substantially perpendicular to the overlapping direction; and an auxiliary mechanism which is arranged adjacently to the take-out position on an upstream side of a take-out direction of the paper sheets by the take-out mechanism, applies a negative pressure to a paper sheet to be supplied to the take-out position by the supply mechanism and second and subsequent paper sheets after the paper sheet is taken out to adsorb them, and moves and halts them in both forward and opposite directions with respect to the take-out direction.

According to still another aspect of the present invention, there is provided a paper sheet separating and take-out device, comprising a deposit section in which a plurality of overlapped paper sheets are deposited; a supply mechanism which moves said plurality of deposited paper sheets in an overlapping direction so as to supply a paper sheet at a front end of a moving direction to a take-out position at one end of the deposit section; a take-out mechanism which comes in contact with the paper sheet supplied to the take-out position and rotates so as to take out the paper sheet in a direction substantially perpendicular to the overlapping direction; a separating mechanism which is arranged fixedly to a side opposite to the take-out mechanism across a conveyance path for conveying the paper sheets on a downstream side of a take-out direction of the paper sheets by the take-out mechanism, and applies a negative pressure to the paper sheets to be taken out onto the conveyance path and simultaneously applies a separating torque in an opposite direction to the take-out direction, so as to separate second and subsequent paper sheets that are carried along with the paper sheet to be taken out from the take-out position; and a space variable mechanism which is arranged on a position for regulating one side of the conveyance path on a position opposed to the separating mechanism, and leaves in a direction in which it separates from the conveyance path due to collision of the paper sheet taken out onto the conveyance path by the take-out mechanism so as to change a space with respect to the separating mechanism.

According to another aspect of the present invention, there is provided a paper sheet separating and take-out device, comprising a deposit section in which a plurality of overlapped paper sheets are deposited; a supply mechanism which moves said plurality of deposited paper sheets in an overlapping direction so as to supply a paper sheet at a front end of a moving direction to a take-out position at one end of the deposit section; a take-out mechanism which comes in contact with the paper sheet supplied to the take-out position and rotates so as to take out the paper sheet in a direction substantially perpendicular to the overlapping direction; a separating mechanism which is arranged on a side opposite to the take-out mechanism across a conveyance path for conveying the paper sheets on a downstream side of a take-out direction of the paper sheets by the take-out mechanism, includes many adsorption holes for applying a negative pressure to the paper sheet to be taken out onto the conveyance path, and applies a separating torque in an opposite direction to the take-out direction to the paper sheet adsorbed by the adsorption holes so as to separate second and subsequent paper sheets that are carried along with the paper sheet to be taken out from the take-out position; a detecting device which detects an adsorption state in which the adsorption holes are opposed to the paper sheets to be conveyed via the conveyance path and a non-adsorption state in which the adsorption holes are not opposed to the paper sheets to be conveyed via the conveyance path; and a control section which controls the separating mechanism based on a detected result from the detecting device.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

An embodiment of the present invention will be described in detail below with reference to the drawings.

Figure 1:
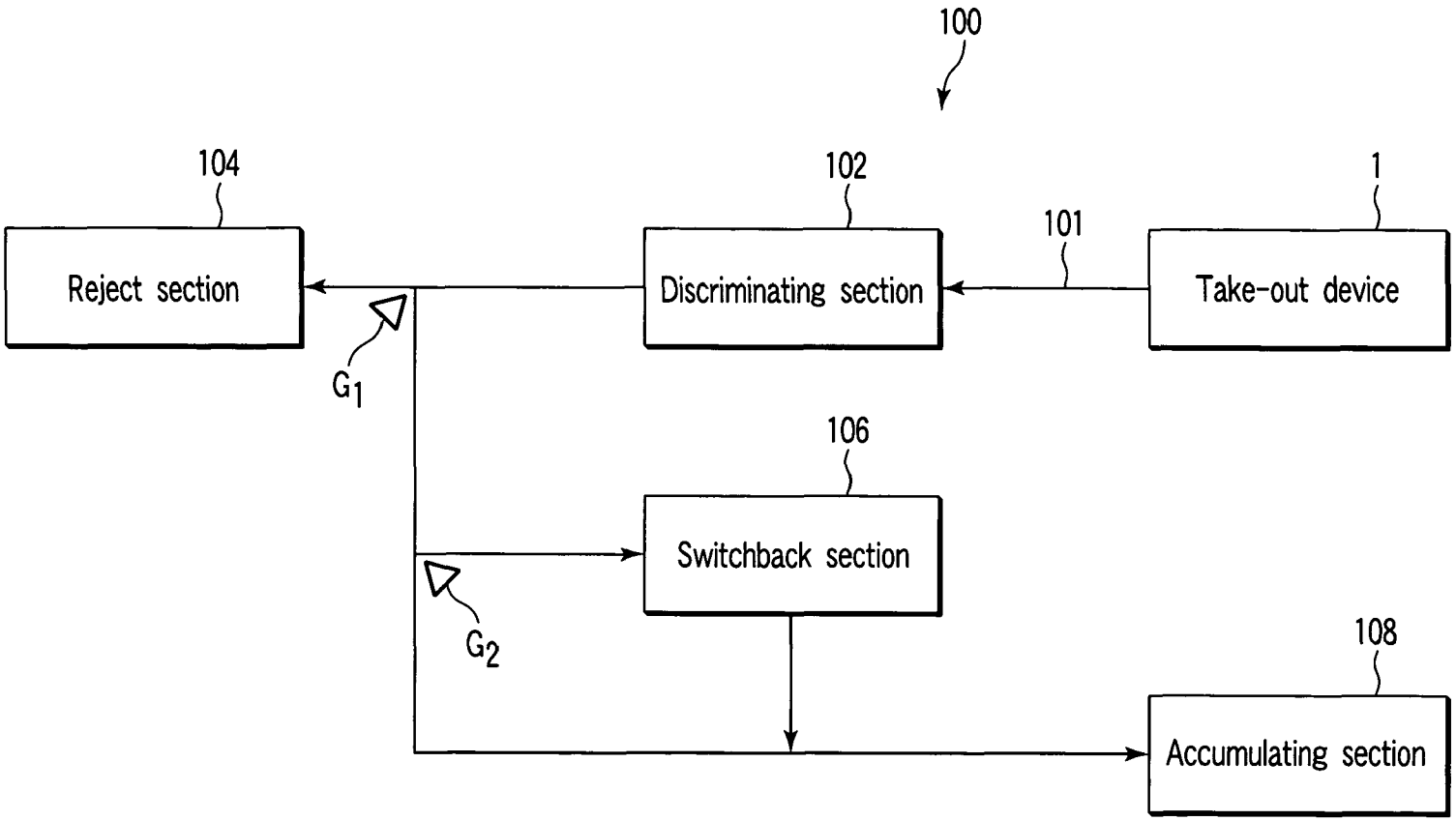
FIG. 1 is a block diagram illustrating a constitution of a postal matter processing device according to an embodiment of the present invention.

FIG. 1 is a block diagram illustrating a schematic constitution of a postal matter processing device 100 (hereinafter, simply the processing device 100) including a paper sheet separating and take-out device 1 (hereinafter, simply the take-out device 1) according to the embodiment of the present invention. The processing device 100 includes the take-out device 1, a discriminating section 102, a reject section 104, a switchback section 106 and an accumulating section 108. Paper sheets to be processed by the processing device 100 in this embodiment are postal matters, but media to be processed (paper sheets) are not limited to postal matters.

Postal matters in an accumulated state are set in the take-out device 1, and the take-out device 1 is operated as mentioned later, so as to take out the postal matters one by one onto a conveyance path 101. Plural pairs of endless conveyance belts (not shown) are extended to the conveyance path 101 so as to sandwich the conveyance path 101, and the postal matters are held by the conveyance belts to be conveyed.

The postal matters taken out onto the conveyance path 101 pass through the discriminating section 102, and various information on the postal matters are read there. The discriminating section 102 discriminates a conveyance posture and a distribution destination of the postal matters based on the read various information. Particularly, the discriminating section 102 reads destination information such as postal codes and addresses written on the postal matters so as to discriminate the distribution destinations.

As to the postal matters having passed through the discriminating section 102, their conveyance directions are sorted via a gate G1. That is, the postal matters discriminated as postal matters to be rejected by the discriminating section 102 are conveyed via the gate G1 to the reject section 104. The other postal matters are conveyed via the gate G1 to the accumulating section 108.

At this time, in the case where the discriminating section 102 discriminates that the conveyance direction of the postal matters should be reversed, the postal matters are sent via a gate G2 to the switchback section 106, in which the conveyance direction is reversed. The postal matters whose conveyance direction does not have to be reversed are allowed to bypass the switchback section 106 via the gate G2 so as to be conveyed to the accumulating section 108.

The postal matters sent to the accumulating section 108 via the conveyance path 101 are distributed and accumulated into distribution/accumulation pockets (not shown) according to the discriminated results in the discriminating section 102. The postal matters distributed and accumulated into the respective distribution/accumulation pockets are accumulated with their tops and bottoms aligned.

Figure 2:
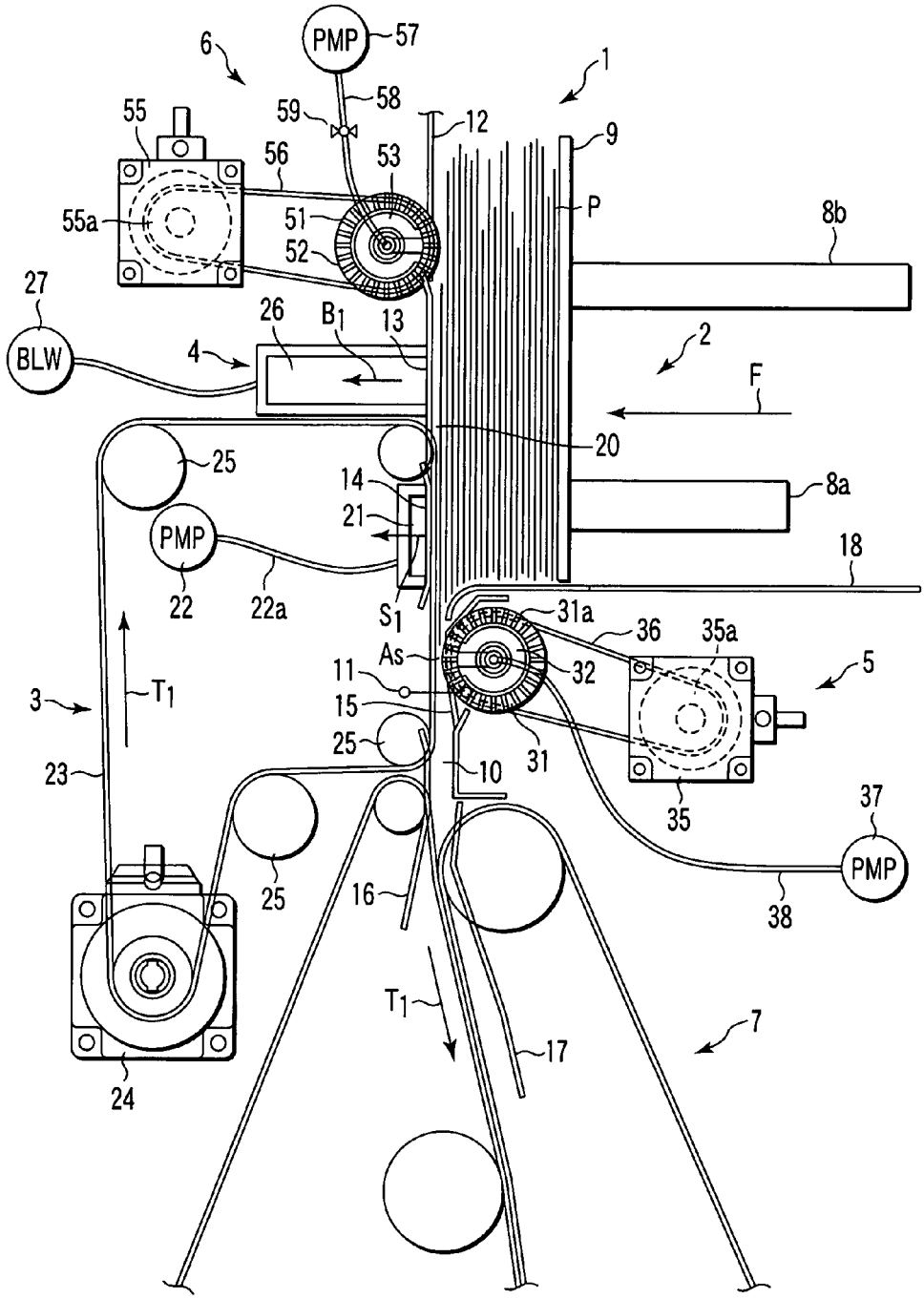
FIG. 2 is a schematic view illustrating a constitution of a take-out device incorporated into the processing device of FIG. 1.

FIG. 2 is a plan view illustrating the take-out device 1 according to the embodiment of the present invention when viewed from above.

The take-out device 1 includes a deposit section 2, supply mechanisms 8 and 9, a take-out mechanism 3, an drawing mechanism 4, a separating mechanism 5, an auxiliary mechanism 6 and a conveyance mechanism 7. A plurality of postal matters P in an overlapped state are deposited in the deposit section 2. The supply mechanisms 8 and 9 move the deposited postal matters P in the overlapping direction so as to supply the postal matter P at a front end of a moving direction to a take-out position 20 which will be mentioned later. The take-out mechanism 3 takes out the postal matter P supplied to the take-out position 20 onto a conveyance path 10 which will be mentioned later. The drawing mechanism 4 draws the postal matter P at the front end of the postal matters P deposited via the deposit section 2 towards the take-out position 20. The separating mechanism 5 separates second and subsequent postal matters P carried along with the postal matter P to be taken out from the take-out position 20. The auxiliary mechanism 6 assists a take-out operation in such a manner that it applies a negative pressure to the postal matter P supplied to the take-out position 20 on an upstream side of the take-out mechanism 3 to move the postal matter P in both forward and opposite directions. The conveyance mechanism 7 draws out the postal matter P which has passed through the separating mechanism 5 at a speed slightly higher than the take-out speed so as to convey it to a downstream side.

The take-out device 1 further includes a sensor 11 which detects passing of the postal matter P taken out from the take-out position 20 at one end of the deposit section 2 onto the conveyance path 10, and a plurality of conveyance guides 12 to 18. The sensor 11 has a light emitting section and a light receiving section which sandwich the conveyance path 10 allowing the postal matters P to pass therethrough. When an optical axis of the sensor 11 is blocked by the postal matter P, the passing of the postal matter P is detected. In this embodiment, plural rows of sensors 11 are arranged in a direction vertical to a sheet surface of FIG. 2, or a line sensor in which elements are arranged in the direction vertical to the sheet surface is arranged. The plurality of conveyance guides 12 to 18 come in contact with an edge side or a surface of the postal matter P so as to guide movement and conveyance of the postal matter P.

The plurality of postal matters P in overlapped and upright states are deposited in the deposit section 2 in bulk. Two endless floor belts 8*a* and 8*b* which come in contact with lower edge sides of the postal matters P so as to move them in the overlapping direction (in the drawing, direction of an arrow F) are arranged at the bottom of the deposit section 2. A backup plate 9 is provided to a position which surface-contacts with the postal matter P at the rear end of the plurality of postal matters P in the moving direction. The backup plate 9 is temporarily connected to the floor belt 8*b* to be cooperative and move in the direction of the arrow F, and supplies the postal matter P at the front end of the moving direction to the take-out position 20. That is, the two floor belts 8*a* and 8*b* and the backup plate 9 function as the supply mechanism of the present invention.

The conveyance guide 18 is projected along the direction of the arrow F on a position where one side of the deposit section 2 is defined and guides the end sides of the postal matters P. The conveyance guides 12, 13 and 14 are arranged along the take-out position 20 at one end of the deposit section 2. The conveyance guides 12, 13 and 14 bring the postal matter P at the front end of the moving direction supplied in the direction of the arrow F to a halt and come in contact with one surface of the postal matter P taken out from the take-out position 20 so as to guide it.

The take-out mechanism 3 has a chamber 21, the guide 14 and a vacuum pump 22 (or corresponding part) (second negative pressure generating mechanism). The take-out mechanism 3 includes an endless take-out belt 23 and a motor 24. A portion in at least a constant region of the take-out belt 23 runs along the take-out position 20 in a direction of an arrow T1 in the drawing (the take-out direction of the postal matter P). The motor 24 drives the take-out belt 23. The take-out belt 23 is wound around a plurality of rollers 25 to stretch and be located such that at least a part of the take-out belt 23 runs along the take-out position 20 and the conveyance path 10 continuous from the take-out position 20 in the direction of the arrow T1.

Figure 3:
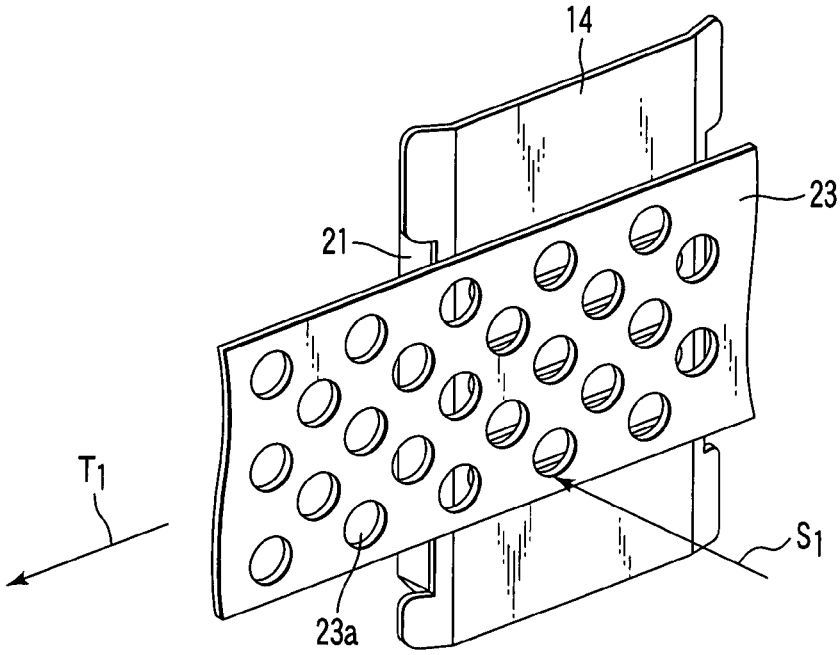
FIG. 3 is a partially enlarged perspective view illustrating an enlarged constitution of a main section of a take-out mechanism in the take-out device in FIG. 2.
Figure 4:
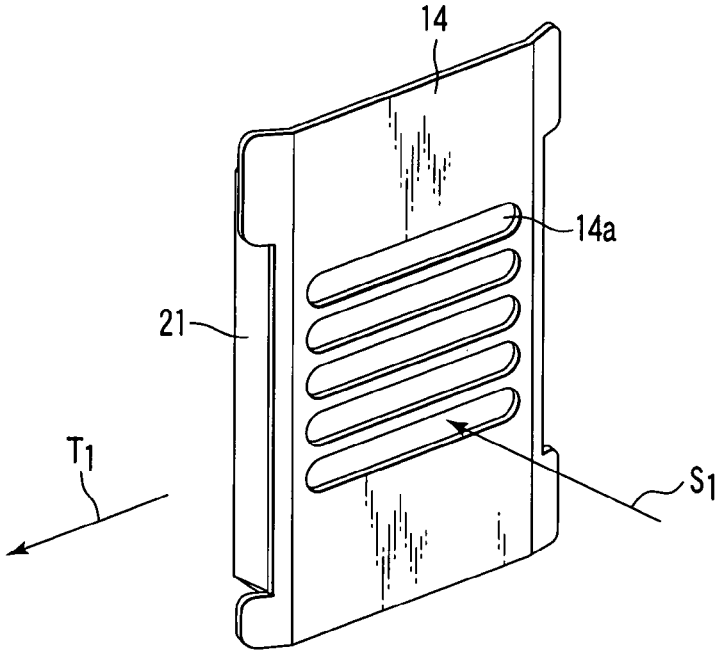
FIG. 4 is a partially enlarged perspective view illustrating a state that a take-out belt is removed from the constitution of FIG. 3.

The guide 14 is arranged on a position which is inside the take-out belt 23 and across the belt from the take-out position 20. The chamber 21 is arranged on a rear surface side of the guide 14, namely, on a position across the take-out belt 23 and the guide 14 from the take-out position 20. The take-out belt 23 has many adsorption holes (second adsorption holes) 23*a* as shown in the partially enlarged drawing of FIG. 3. The guide 14 has, as shown in FIG. 4, a plurality of elongated slits 14*a* along the running direction of the take-out belt 23 (namely, the take-out direction of the postal matter P) T1.

Therefore, when the vacuum pump 22 is operated so that the chamber 21 is vacuumed, a negative pressure (an arrow S1 in the drawing) is applied to the postal matter P supplied to the take-out position 20 via an opening (not shown) of the chamber 21 opposed to the guide 14, the plurality of slits 14*a* of the guide 14 and the adsorption holes 23*a* of the take-out belt 23 running in the direction of the arrow T1. The postal matter P is adsorbed to the surface of the take-out belt 23 and is taken out from the take-out position 20 onto the conveyance path 10 according to the running of the take-out belt 23.

At this time, the adsorption force in the direction of the arrow S1 generated by the vacuum pump 22 is set so that a conveyance force for delivering the first postal matter P adsorbed to the take-out belt 23 in the take-out direction T1 is at least stronger than a frictional force applied between a first paper sheet and a second paper sheet. The take-out mechanism 3 basically separates the postal matters P on the take-out position 20 one by one so as to deliver them onto the conveyance path 10. However, the postal matters P, which are overlapped and are delivered onto the conveyance path 10, are separated by the separating mechanism 5, mentioned later, one by one.

Figure 5:
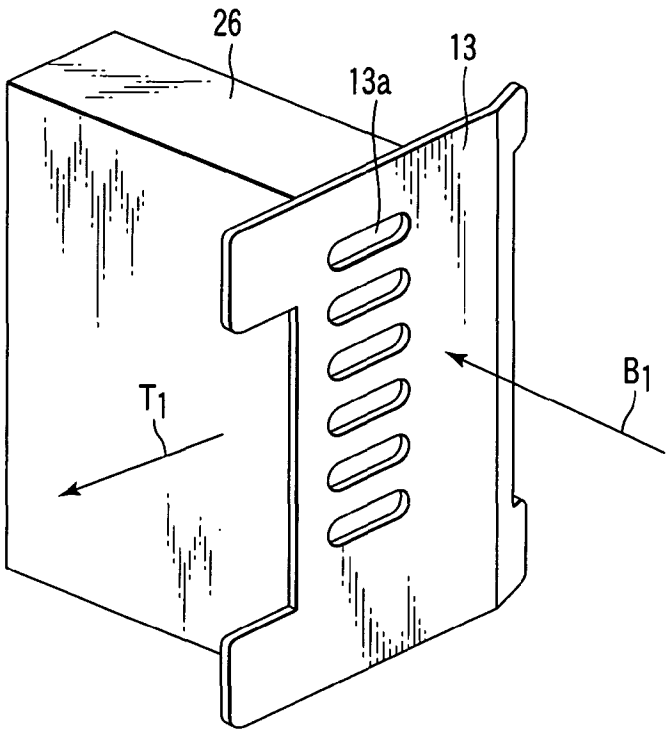
FIG. 5 is a partially enlarged perspective view illustrating a main section of a drawing mechanism incorporated into the take-out device in FIG. 2.

The drawing mechanism 4 has a chamber 26 arranged on a rear surface side of the conveyance guide 13 with respect to the take-out position 20, and a blower 27 (or corresponding part) for sucking air in the chamber 26. The chamber 26 is arranged between the take-out mechanism 3 and the auxiliary mechanism 6 which will be described later such that its opening (not shown) is adjacent to the take-out position 20 and is opposed to the rear surface of the guide 13. The guide 13 has, as shown in a partially enlarged view of FIG. 5, a plurality of holes 13*a* which match the width of the opening of the chamber 26.

When the blower 27 is operated so as to suck the air in the chamber 26, air flows in a direction of an arrow B1 in the drawing are generated via the plurality of holes 13*a* of the guide 13. The postal matter P of the postal matters P deposited in the deposit section 2 which is the closest to the take-out position 20 is drawn towards the take-out position 20. After the postal matter P drawn to the take-out position 20 is taken out, the next postal matter P is drawn towards the take-out position 20. That is, when the drawing mechanism 4 is provided, the postal matter P to be taken out next can be supplied to the take-out position 20 quickly. Even when the supply force towards the direction of the arrow F by means of the supply mechanisms 8 and 9 is weakened, only the first postal matter P can be always supplied to the take-out position 20 stably and quickly. As a result, the speed of the take-out operation of the postal matters P by means of the take-out mechanism 3 can be heightened.

The separating mechanism 5 is provided to an opposite side to the take-out mechanism 3 across the conveyance path 10 extending to the downstream side (lower direction of FIG. 2) of the take-out position 20. The separating mechanism 5 applies a negative pressure to the postal matters P conveyed via the conveyance path 10 from an opposite side to the take-out mechanism 3 and simultaneously supplies a separating torque in a direction opposite to the take-out direction of the postal matters P. That is, with this operation of the separating mechanism 5, even when second and subsequent postal matters P are carried along with the postal matter P to be taken out from the take-out position 20 (occasionally three or more postal matters are overlapped and taken out), the second and subsequent postal matters P are brought to a halt by the negative pressure and the separating torque or are returned in the opposite direction so as to be separated from the first postal matter P.

Figure 6:
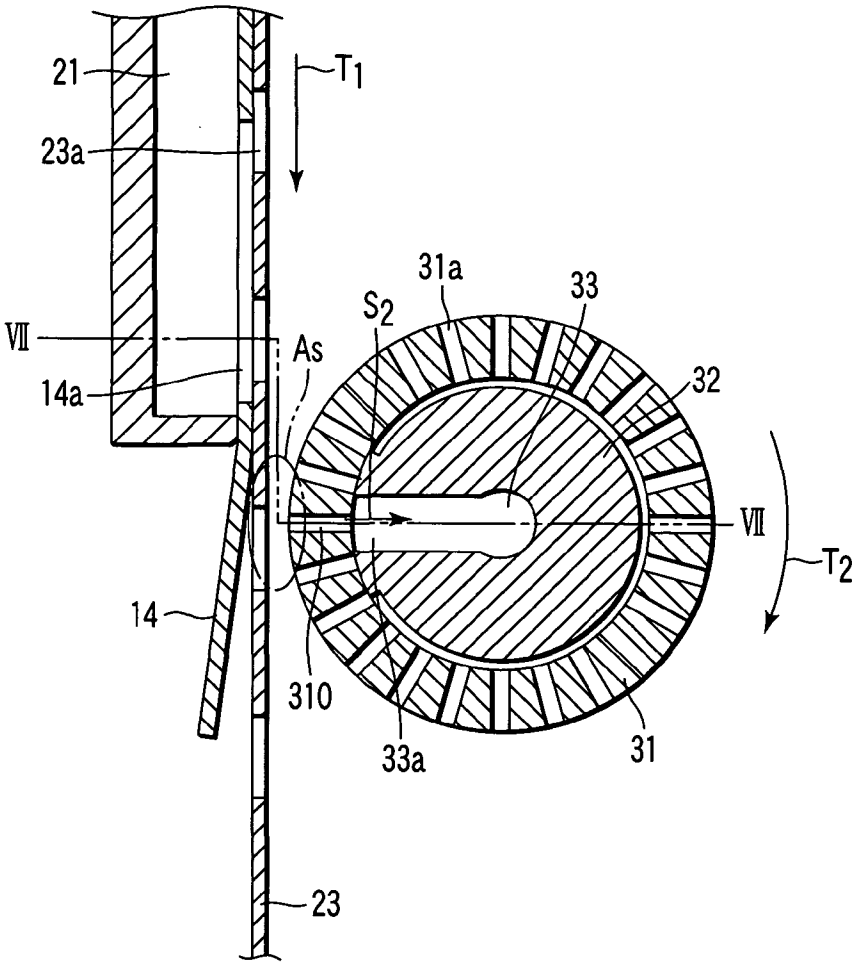
FIG. 6 is a partially enlarged perspective view illustrating a main section of a separating mechanism incorporated into the take-out device in FIG. 2.
Figure 7:
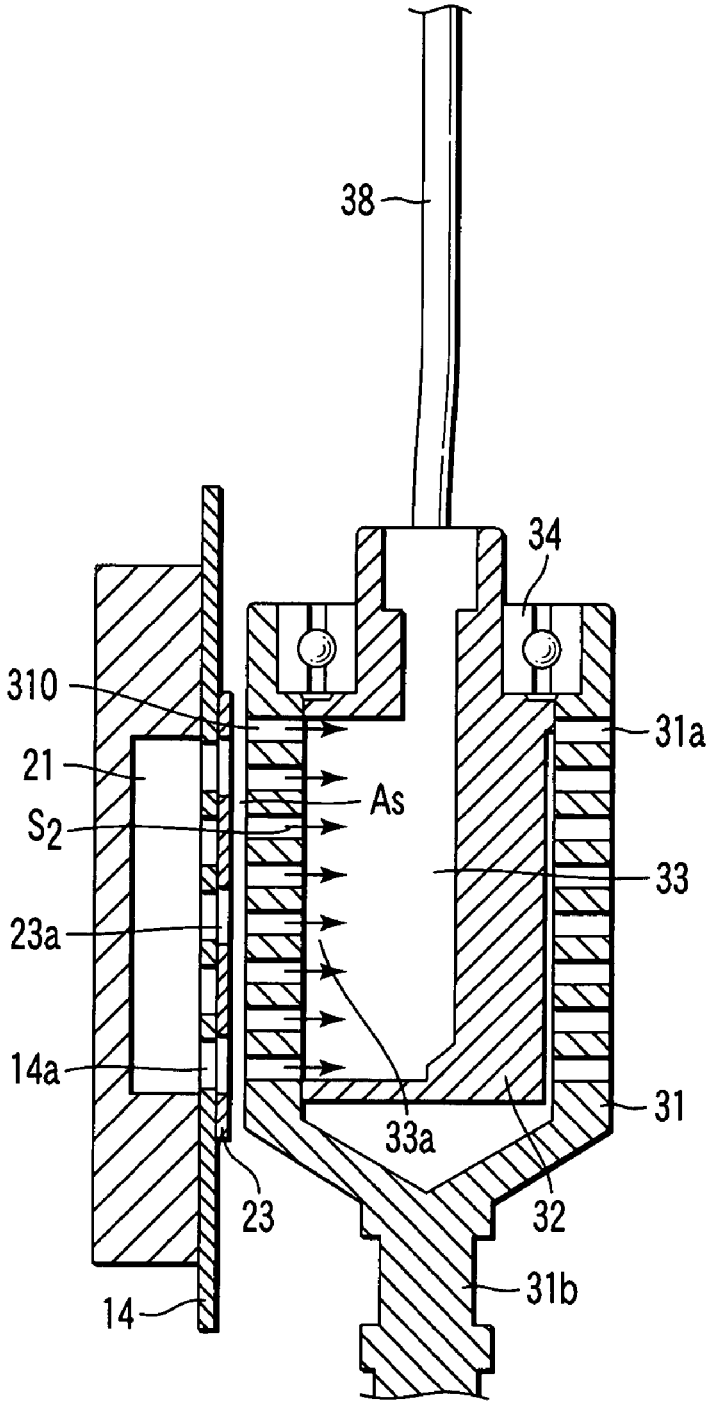
FIG. 7 is a partially enlarged sectional view illustrating the constitution in FIG. 6, taken along a break line VII-VII.

More specifically, as shown in the partially enlarged view of FIG. 6, the separating mechanism 5 has a separating roller 31 provided rotatably in both forward and opposite directions along the take-out direction T1 of the postal matters P. The separating roller 31 is, as shown in also FIG. 7, mounted on a rotating shaft mounted fixedly to the conveyance path 10, namely, a cylindrical body 32 having a chamber 33, mentioned later, so as to be rotatable via bearings 34. The separating roller 31 has many adsorption holes 31*a* (first adsorption holes) which pierce therethrough such that its inner peripheral surface and its outer peripheral surface are connected. The separating roller 31 is formed by a rigid body such as a metal material having a substantially cylindrical shape and is located on a position where its outer peripheral surface is exposed on the conveyance path 10. The cylindrical body 31 as the rotating shaft has the chamber 33 for generating a negative pressure, and is installed securely and located such that an opening 33*a* of the chamber 33 faces the conveyance path 10. FIG. 7 is a sectional view taken along break line VII-VII of FIG. 6.

The separating mechanism 5 includes an AC servo motor 35 (first driving section) and an endless timing belt 36. The AC servo motor 35 rotates the separating roller 31 in both forward and opposite directions by means of a desired torque. The timing belt 36 transmits the driving force of the motor 35 to the separating roller 31. The timing belt 36 is wound around a pulley 35*a* fixed to a rotating shaft of the motor 35 and a pulley (not shown) fixed to a rotating shaft 31*b* (see FIG. 7) of the separating roller 31 so as to stretch therebetween. The separating mechanism 5 has a vacuum pump 37 (or corresponding part) (first negative pressure generating mechanism) which is connected via a piping 38 to the chamber 33 of the cylindrical body 32 to which the separating roller 31 is rotatably mounted.

When the vacuum pump 37 is operated so as to vacuum the chamber 33, a negative pressure (an arrow S2 in the drawing) is applied to the surface of the postal matter P passing through the conveyance path 10 via the opening 33*a* of the chamber 33 and specified adsorption holes 310 of the adsorption holes 31*a* of the separating roller 31 opposed to the opening 33*a*. As a result, the postal matter P is adsorbed to the outer peripheral surface of the separating roller 31. At this time, in the case where the separating roller 31 rotates, the conveyance force along the rotating direction of the separating roller 31 is applied also to the postal matter P adsorbed to the outer peripheral surface of the separating roller 31. In the following description, an area where the negative pressure is applied to the postal matter P via the adsorption holes 310 of the separating roller 31 is called a separating area As.

On the other hand, the AC server motor 35 drives to control the separating roller 31 so as to always apply a constant separating torque in a direction opposite to the take-out direction (direction of an arrow T2 in the drawing) to the separating roller 31. In the case where one postal matter P is conveyed via the conveyance path 10, the separating torque is set so that the separating roller 31 which adsorbs this postal matter P can rotate together with the postal matter P along the conveyance direction. In the case where a plurality of overlapped postal matters P are taken out onto the conveyance path 10, the separating torque is set so that the second and subsequent postal matters P on the side of the separating roller 31 are brought to a halt or are returned in the opposite direction to be separated from the first postal matter P.

Figure 8:
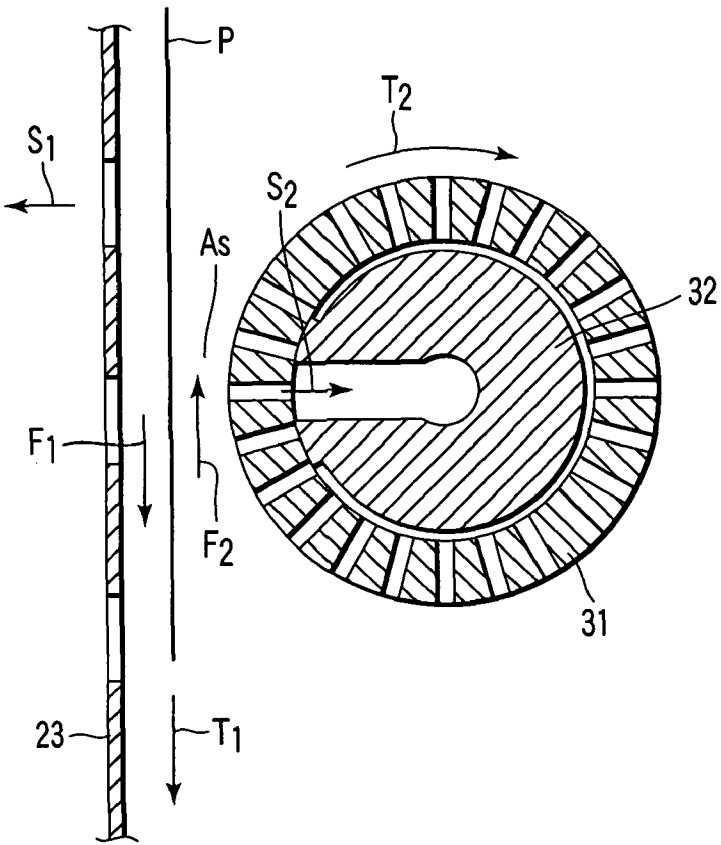
FIG. 8 is a partially enlarged sectional view illustrating behaviors of a separating roller and one postal matter in a state that the postal matter is conveyed via a conveyance path.

That is, as shown in FIG. 8, in a state that one postal matter P is properly taken out from the take-out position 20 and conveyed via the conveyance path 10, a conveyance force F1 of the forward direction (direction of an arrow T1) becomes stronger than a conveyance force F2 of the opposite direction. The conveyance force F1 is applied to the postal matter P by the take-out mechanism 3. The conveyance force F2 is applied to the postal matter P by the separating roller 31 to which the separating torque in the opposite direction (direction of the arrow T2) has been applied. The postal matter P is conveyed in the forward direction T1, and the separating roller 31 rotates together with the postal matter P or is brought to a halt or rotates around in aimless circles in the direction opposite to the take-out direction.

Assume that, in the case where the separating roller 31 rotates around in aimless circles in the opposite direction, the constant separating torque is continuously applied. The rotating speed becomes gradually higher, and a bad influence is exerted on the taking-out of the postal matter P. For this reason, in this embodiment, the reverse rotating speed of the separating roller 31 has an upper limit. Specifically, the upper limit speed is set so that an absolute value is smaller than the take-out speed of the postal matters P.

In this embodiment, the separating area As to which the separating roller 31 is opposed is present on a position where the postal matter P is adsorbed to the take-out belt 23, namely, a position separated towards the downstream side of the take-out direction T1 from the position where the chamber 21 is opposed to the take-out position 20. For this reason, even if a negative pressure S1 generated by the chamber 21 is made to be sufficiently stronger than a negative pressure S2 generated by the separating roller 31, it is highly possible that only one postal matter P to be conveyed is attracted to and is brought into contact with the separating roller 31.

Figure 9:
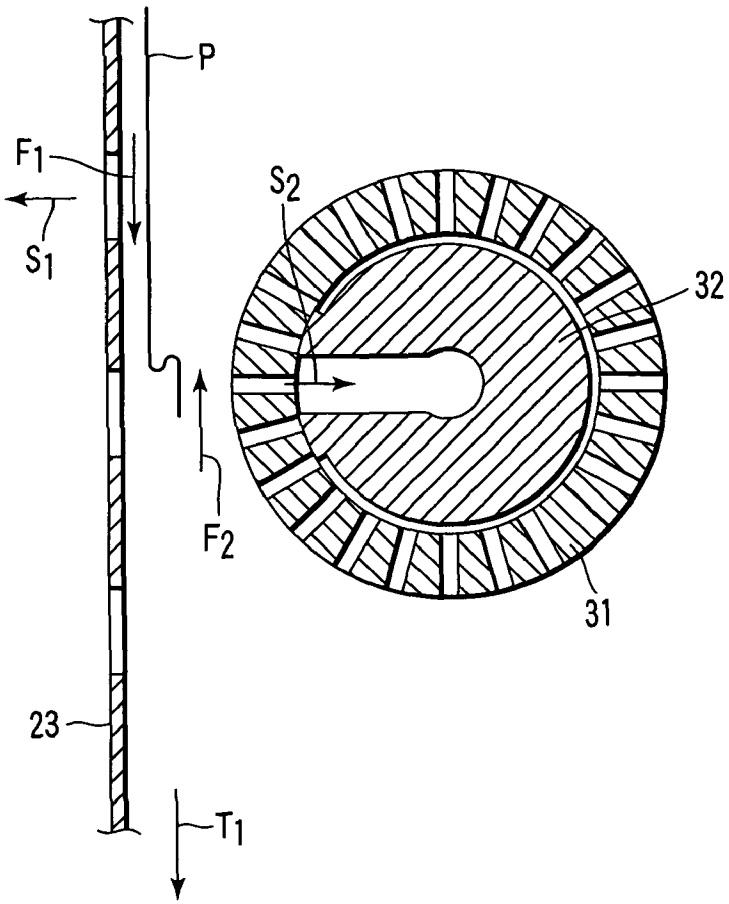
FIG. 9 is a partially enlarged sectional view illustrating a state that one postal matter taken out onto the conveyance path is bent.
Figure 10:
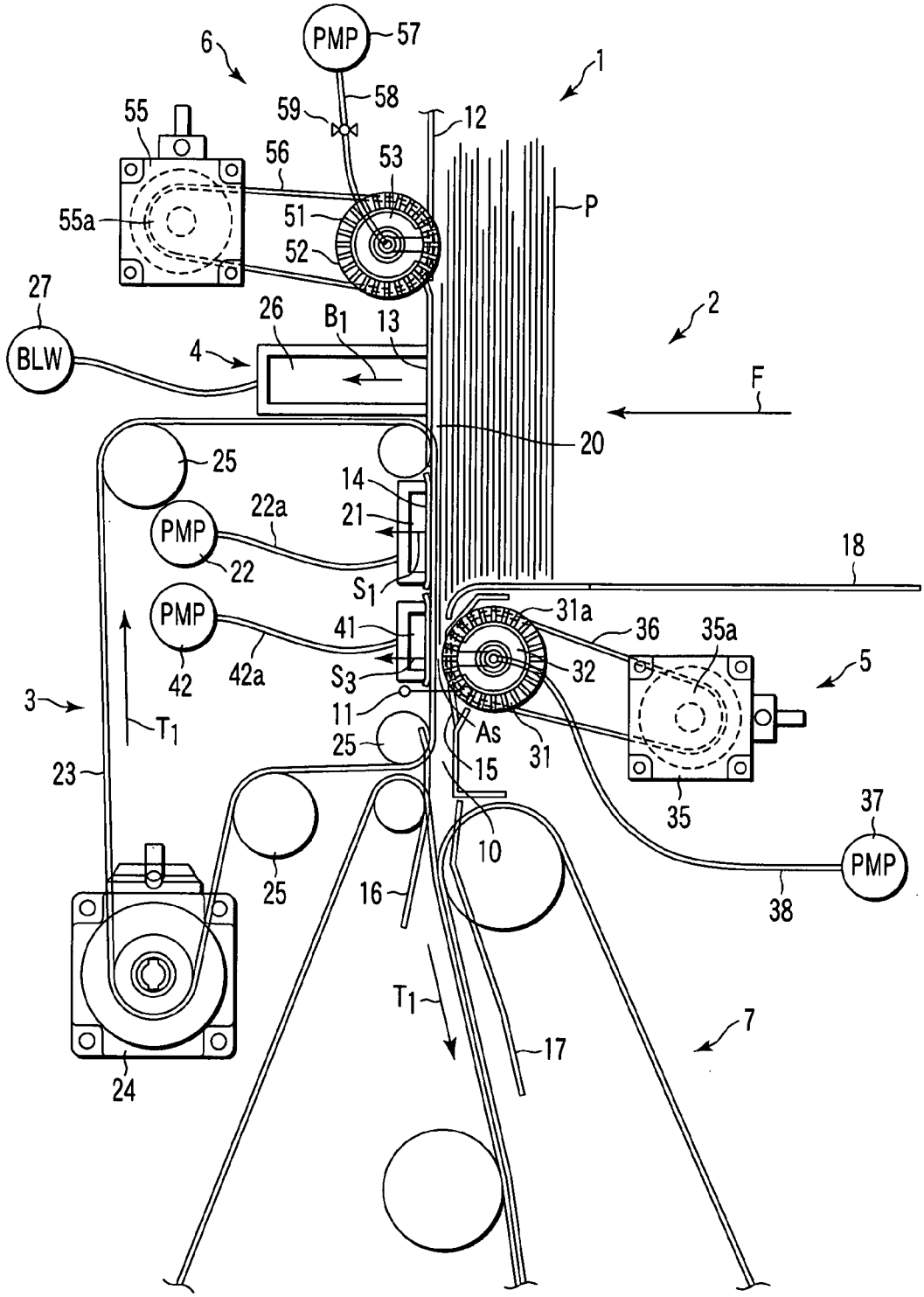
FIG. 10 is a schematic view illustrating the take-out device to which a chamber for adsorption opposed to the separating roller is added.

In this case, for example, when the postal matter P is a thin postal matter P with comparatively infirm, a return force in the opposite direction by means of the separating roller 31 acts excessively on the postal matter P as shown in FIG. 9, and as a consequence, the postal matter P is potentially bent as shown in the drawing. For this reason, as shown in FIG. 10, it is desirable that a chamber 41 is added to a position opposed to the separating roller 31 inside the take-out belt 23 (separating area As), and a vacuum pump 42 (third negative pressure generating mechanism) for vacuuming the chamber 41 is added. A negative pressure S3 in a direction towards the take-out belt 23 is applied to the postal matter P at a position opposed to the separating area As, so that the problem of the bending shown in FIG. 9 can be solved.

Figure 11:
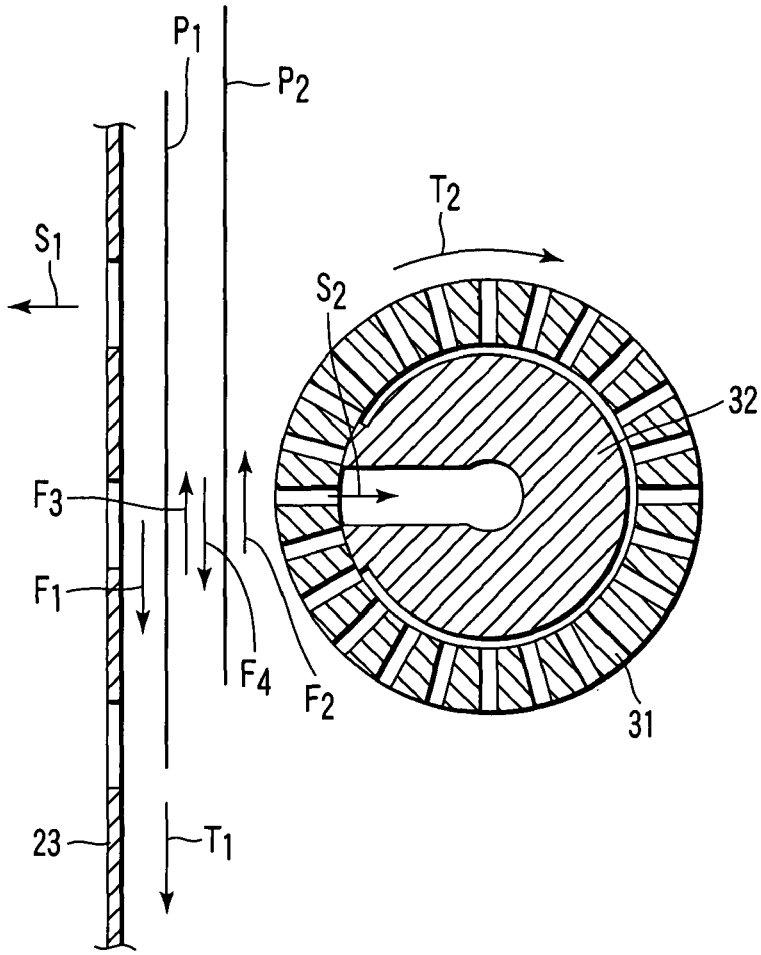
FIG. 11 is a partially enlarged sectional view illustrating behaviors of the separating roller and two postal matters in a state that the postal matters in an overlapped state are conveyed via the conveyance path.

On the other hand, as shown in FIG. 11, in the case where two overlapped postal matters P are taken out from the take-out position 20 onto the conveyance path 10, the conveyance force F1 is applied from the take out mechanism 3 to a first postal matter P1 closer to the take-out belt 23, and this postal matter P1 is conveyed in the forward direction T1. The conveyance force F2 of the opposite direction T2 is applied from the separating roller 31 to a second postal matter P2 closer to the separating roller 31. At this time, frictional forces F3 and F4 of opposite directions are applied between the two postal matters P1 and P2. While the frictional forces F3 and F4 are generated in a state that the two postal matters P1 and P2 come in contact with each other, the forces F3 and F4 become zero when the postal matters P1 and P2 are separated from each other.

In any cases, the conveyance forces F1 and F2 applied to the two postal matters P1 and P2 are set to sufficiently larger values than maximum values of the frictional forces F3 and F4 generated therebetween. For this reason, the second postal matter P2 to which the conveyance force F2 of the reverse direction has been applied is returned in the opposite direction T2 to the take-out direction T1 so as to be separated from the first postal matter P1.

The separating roller 31 is formed by a metal roller, and the separating torque is applied to the postal matter P taken out onto the conveyance path 10 and a negative pressure is applied to the postal matter P. As a result, the use life of the roller can be extended more greatly than a separating roller formed by a conventional rubber roller. Its separating performance can be maintained satisfactorily for a long time, and the speed of processing the postal matters P can be heightened to improve its throughput. In a state that only one postal matter P is taken out, there is a high possibility that the separating roller 31 rotates in aimless circles. For this reason, in cases other than the case where the plurality of overlapped postal matters P are taken out (multiple feed), the separating torque to be applied to the separating roller 31 may be set to zero.

As shown in FIG. 2, the auxiliary mechanism 6 which is arranged above the drawing mechanism 4, namely, on the upstream side along the take-out direction T1 of the postal matters P has substantially the same constitution as that of the separating mechanism 5. In other words, the auxiliary mechanism 6 has an auxiliary roller 51 provided rotatably in both forward and opposite directions along the take-out direction T1 of the postal matter P.

The auxiliary roller 51 is rotatably mounted on a rotating shaft provided fixedly to the take-out position 20, namely, a cylindrical body 53 having a chamber inside. The auxiliary roller 51 has many adsorption holes 52 (third adsorption holes) which pierce such that its inner peripheral surface is connected to its outer peripheral surface. Further, the auxiliary roller 51 is formed by a rigid body such as a substantially cylindrical metal material, and is located on a position where its outer peripheral surface is exposed on the take-out position 20. The cylindrical body 53 as the rotating shaft has a chamber for generating a negative pressure, and is located and installed in a posture such that an opening of the chamber faces the take-out position 20.

The auxiliary mechanism 6 has an AC servo motor 55 (second driving section) and an endless timing belt 56. The AC servo motor 55 rotates the auxiliary roller 51 in both forward and opposite directions by means of a desired torque. The timing belt 56 transmits a driving force generated by the motor 55 to the auxiliary roller 51. The timing belt 56 is wound around a pulley 55*a* fixed to a rotating shaft of the motor 55 and a pulley (not shown) fixed to a rotating shaft of the auxiliary roller 51 so as to be stretched. The auxiliary mechanism 6 further has a vacuum pump 57 (or corresponding part) (fourth negative pressure generating mechanism) which is connected via a piping 58 to the chamber of the cylindrical body 53 to which the auxiliary roller 51 is rotatably mounted. A solenoid valve 59 for turning the negative pressure on or off is mounted on a mid-portion of the piping 58.

The auxiliary mechanism 6 rotates and stops the auxiliary roller 51 in both the forward and opposite directions at a desired speed, and turns the negative pressure generated by the vacuum pump 57 on or off. In such a manner, the auxiliary mechanism 6 supports the operations for taking out and separating the postal matters P. For example, in the case where the postal matter P supplied to the take-out position 20 is taken out by the take-out mechanism 3, the negative pressure is applied to a rear end side of the take-out direction of the postal matter P so that the postal matter P is adsorbed. The auxiliary roller 51 is rotated in the forward direction T1 to thereby support the taking-out of the postal matter P. As a result, when a larger postal matter P whose weight is comparatively large, for example, is taken out, a strong and stable conveyance force can be applied, thereby making the operation for taking out the postal matter P stable.

In a state that the first postal matter P is taken out by the take-out mechanism 3, the rear end of the postal matter P in the take-out direction goes to a position where the rear end does not interfere with the auxiliary roller 51. Thereafter, a rear end side of the second postal matter P supplied to the take-out position next is adsorbed to the auxiliary roller 51, and a desired torque in the opposite direction is applied, so that the brake can be applied to the second postal matter P. The auxiliary mechanism 6 cooperates with the separating mechanism 5 so as to prevent multiple feed of the postal matters P. In this case, the torque in the opposite direction to be applied to the auxiliary roller 51 is controlled and the time for the application of the brake is controlled. Consequently, a gap and a pitch of the postal matters P to be taken out from the take-out position 20 onto the conveyance path 10 can be controlled.

Figure 14:
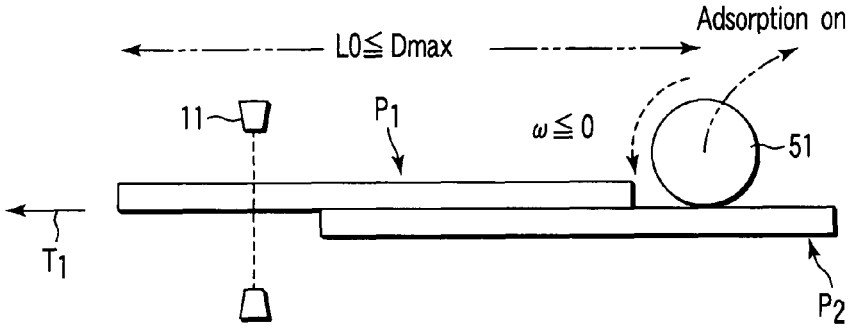
FIG. 14 is a pattern diagram illustrating a third control state of the auxiliary mechanism.
Figure 15:
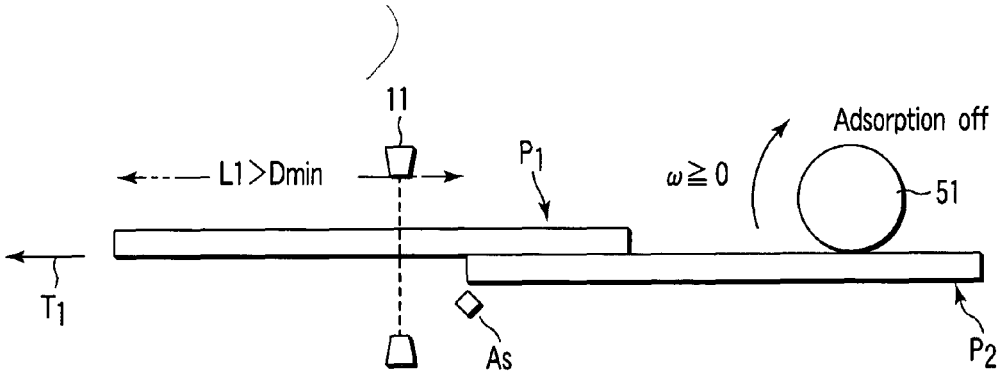
FIG. 15 is a pattern diagram illustrating a fourth control state of the auxiliary mechanism.
Figure 16:
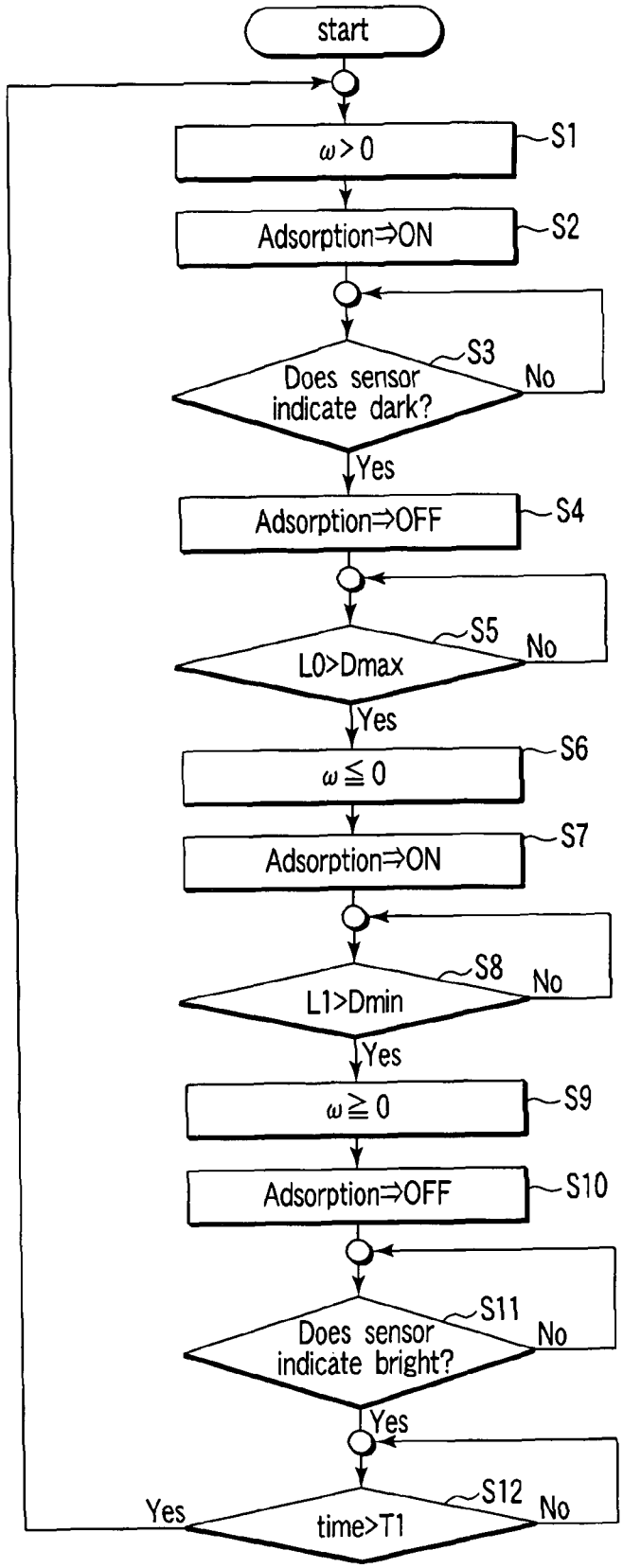
FIG. 16 is a flowchart illustrating the first to fourth control operations by means of the auxiliary mechanism.

Specifically, the auxiliary mechanism 6 is brought into four kinds of control states shown in FIGS. 12 to 15, and operates according to a flowchart shown in FIG. 16. The auxiliary mechanism 6 controls "the rotating speed" (including the direction) of the auxiliary roller 51 and "presence/non-presence of the negative pressure", so as to be in the four kinds of control sates. "The rotating speed" is controlled by the AC servo motor 55, and "the presence/non-presence of the negative pressure" is controlled by opening/closing the solenoid valve 59.

Figure 12:
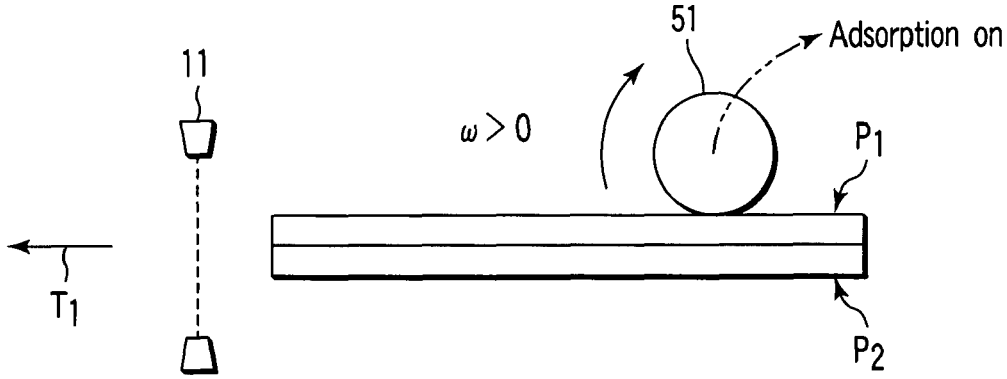
FIG. 12 is a pattern diagram illustrating a first control state of an auxiliary mechanism.

In the first control state shown in FIG. 12, the auxiliary roller 51 rotates along the take-out direction T1 of the postal matter P at an angular speed ω, and the solenoid valve 59 is opened so that the negative pressure is applied to the first postal matter P1 supplied to the take-out position 20. In this state, the postal matter P1 being in contact with the auxiliary roller 51 is adsorbed to the peripheral surface of the auxiliary roller 51 so as to synchronize with the rotation of the auxiliary roller 51. As a result, the postal matter P1 is biased in the direction of the arrow T1 at a constant speed.

Figure 13:
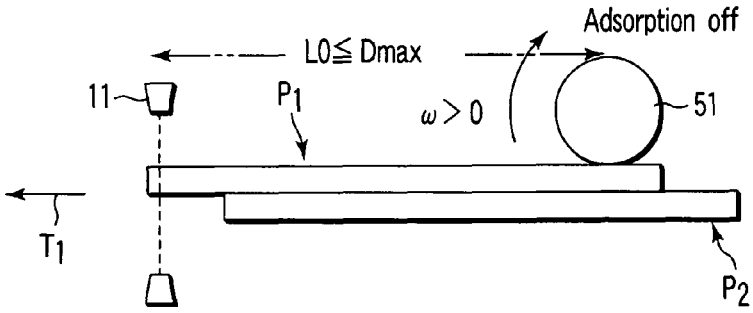
FIG. 13 is a pattern diagram illustrating a second control state of the auxiliary mechanism.

In the second control state shown in FIG. 13, namely, in the state that the front end of the first postal matter P1 reaches the sensor 11, the auxiliary roller 51 rotates in the take-out direction T1 of the postal matter P at the constant angular speed ω. The solenoid valve 59 is closed to bring the negative pressure into the OFF state. In this state, the first postal matter P1 does not always move at a speed in synchronization with the rotation of the auxiliary roller 51. That is, in this state, the postal matter P1 can move quickly or slowly due to an influence of another element.

In the third control state shown in FIG. 14, namely, in the state that the rear end of the first postal matter P1 in the take-out direction shifts from the position where the rear end of the first postal matter P1 in the take-out direction interferes with the auxiliary roller 51, the auxiliary roller 51 stops or rotates in the direction opposite to the take-out direction T1 at a constant angular speed. The solenoid valve 59 is opened to generate the negative pressure. In this state, the second postal matter P2 stops or is fed in the opposite direction and the brake is applied thereto so as to assist the separation from the first postal matter P1.

In the fourth control state shown in FIG. 15, the auxiliary roller 51 stops or rotates in the take-out direction T1 at a constant angular speed, and the solenoid valve 59 is closed to bring the negative pressure into the OFF state. As a result, a gap is formed between the precedent first postal matter P1 and the second postal matter P2 contacting with the auxiliary roller 51, and the second postal matter P2 is delivered by a weak force.

The auxiliary mechanism 6, as shown in FIG. 16, transits the first to fourth control states based on information from the sensor 11 and length range information about a postal matters P to be processed. As a result, the auxiliary mechanism 6 efficiently takes out and separates a plurality of postal matters P deposited collectively.

The auxiliary roller 51 is in the first control state at the time of starting the operation for taking out the postal matters P. That is, a negative pressure is applied to the peripheral surface of the auxiliary roller 51 and the auxiliary roller 51 rotates in the forward direction (step 12). An output from the sensor 11 is monitored and when an output signal from the sensor 11 indicates "dark" (the state that the postal matter P blocks the optical axis of the sensor) (Yes in step 3), the control state is transited to the second control state. In other words, at this time, the solenoid valve 59 is closed so that the negative pressure is made to be disappear (step 4).

A distance L0 from the front end of the first postal matter P1 to the counter position of the auxiliary roller 51 becomes longer than the longest length Dmax of the postal matter P, namely, the rear end of the first postal matter P1 in the take-out direction shifts from the auxiliary roller 51 (YES in step 5). At this time, the control state is transited to the third control state based on the information from the sensor 11 (elapsed time from indication of "dark"), geometric information about the auxiliary roller 51 and the range information about the postal matter P. That it, at this time, the auxiliary roller 51 is stopped or rotated reversely (step 6) so that the negative pressure is applied thereto (step 7).

When a distance L1 from the front end of the first postal matter P1 to the separating area As becomes longer than the shortest length Dmin of the postal matter (YES in step 8), the third control state is transited to the fourth control state. In other words, at this time, the auxiliary roller 51 is stopped or rotated to the forward direction (step 9), and the solenoid valve 59 is closed, thereby making the negative pressure disappear (step 10).

The sensor 11 is monitored, the output from the sensor 11 indicates "bright" (YES in step 11), and the constant time T1 passes (YES in step 12). Thereafter, the fourth control state is returned to the first control state, and the steps 1 to 12 are continued until the stop command is output from an upper control system.

When the auxiliary mechanism 6 is provided adjacently to the take-out position 20 of the postal matter P, the operations for taking out and separating the postal matters P can be assisted. Further, the speed of processing the postal matters P can be heightened, and the throughput can be heightened. The negative pressure by means of the auxiliary mechanism 6 is controlled so that the postal matter P can be adsorbed to the auxiliary roller 51. Accordingly, the auxiliary roller 51 can be formed by a metal roller, so that the stable operation can be performed for a long time.

The processing operation in the case where the multiple feed does not occur in the take-out device 1 will be described below with reference to FIG. 2.

The postal matters P set on the deposit section 2 are sent in the direction of the arrow F by the supply mechanism 8, 9, and are attracted to the take-out position 20 one by one by the drawing mechanism 4. When the drawing mechanism 4 is provided, the first postal matter P can be arranged on the take-out position 20 quickly even if the supply force for the postal matters P by the supply mechanism 8, 9 is weakened.

The postal matter P attracted to the take-out position 20 is adsorbed to the surface of the take-out belt 23 of the take-out mechanism 3 and receives the conveyance force from the take-out belt 23 so as to be delivered in the take-out direction T1. The delivered postal matter P is drawn out by the conveyance mechanism 7 so as to be conveyed to the lower stream via the conveyance path 10.

At this time, when the conveyance speed for the postal matter P in the entire device (namely, the conveyance mechanism 7) is designated by Va, a relationship Va≧V is established with respect to the delivery speed V for the postal matter P at the time of taking out. That is, the postal matters P are drawn out by the conveyance mechanism 7 and are accelerated, so that the separation of the postal matters P can be promoted. As a difference between Va and V is larger, the gap between the postal matters P can be widened.

When the speed difference becomes too large, the conveyance state goes wrong on a speed change portion, thereby causing dispersion of the conveyance position of the postal matters P. As V is smaller, the number of the postal matters P per unit time delivered from the deposit section 2 becomes smaller. For this reason, the throughput is lowered.

As a method of solving the above problem and promoting the separation effectively, a method of increasing/decreasing the speed of the take-out belt 23 (AC servo motor 24) is present. More specifically, the initial speed of the take-out belt 23 is set to a value close to Va, and for example, the timing at which the precedent postal matter P is drawn out by the conveyance mechanism 7 to obtain the speed Va is acquired by using the sensor 11. The speed of the take-out belt 23 is reduced at this timing, and the take-out belt 23 is reaccelerated to the initial speed Va at timing where a necessary gap is formed. As a result, the above problems (the conveyance dispersion and the lowering of the throughput) are avoided as much as possible, and the take-out belt 23 is temporarily deaccelerated so that the its speed is made to be different from Va. This allows the gap to be easily formed.

The sensor 11 is provided to monitor the passing of the front end or the rear end of the postal matters P and monitor the gap between the postal matters P. In the take-out control, such information is used or can be a trigger. Examples of subjects to be controlled include a control signal of the AC servo motor 24 in the case where the take-out belt 23 is accelerated/deaccelerated and a more suitable gap is tried to be formed, and a control signal of the solenoid valve in the case where the solenoid value is provided to the pipings 22*a* and 58 connected to the vacuum pumps 22 and 57 and presence/non-presence of the air suction is tried to be controlled.

Figure 17:
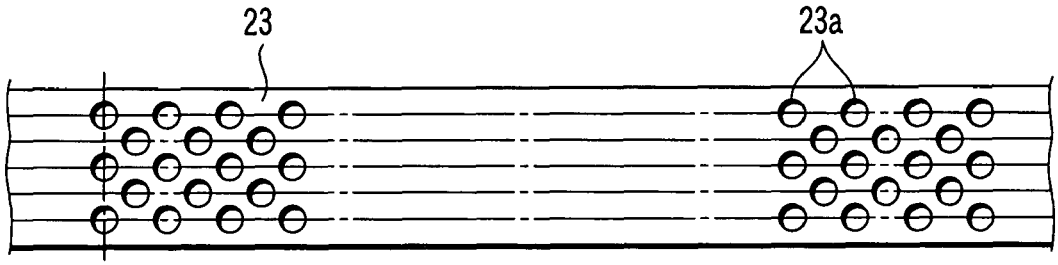
FIG. 17 is a partially enlarged view illustrating a take-out belt having adsorption holes provided intermittently along a longitudinal direction.
Figure 18:
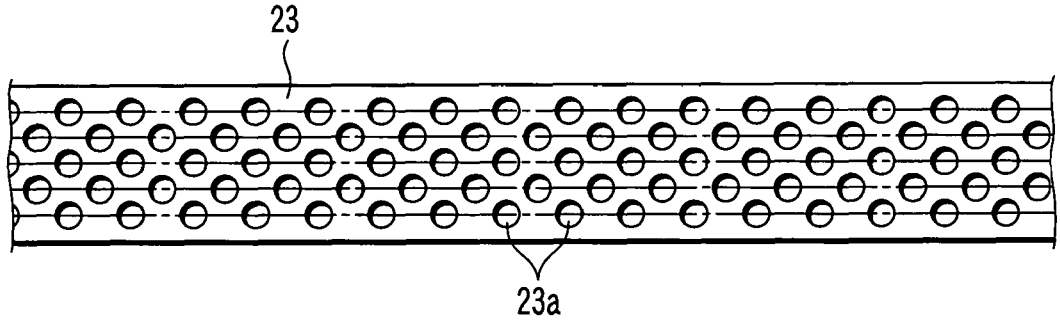
FIG. 18 is a partially enlarged view illustrating the take-out belt having adsorption holes continuing along the longitudinal direction.

The take-out belt 23 includes ones shown in FIGS. 17 and 18. As to the take-out belt 23 shown in FIG. 17, areas having many adsorption holes 23*a* along its longitudinal direction and areas where no adsorption hole 23*a* is present are arranged alternately. As to the take-out belt 23 shown in FIG. 18, many adsorption holes 23*a* are formed continuously along its longitudinal direction.

In the case where the take-out belt 23 shown in FIG. 17 is used, one postal matter P is adsorbed to the belt every time when a hole group periodically appears. For this reason, the postal matters P are taken out with constant pitch. On the other hand, in the case where the take-out belt 23 shown in FIG. 18 having continuous holes is used, the postal matters P are adsorbed sequentially to the belt surface to be delivered. For this reason, the throughput (processing speed) can be heightened.

On the other hand, since the belt shown in FIG. 18 makes it difficult to form the gap between the postal matters P, the adsorption operation by the take-out mechanism 3 should be turned on or off so that the gap between the postal matters P is formed. For that purpose, a solenoid valve is provided to the piping 22*a* and the solenoid valve should be opened/closed based on the information from the sensor 11.

The following method of controlling the solenoid valve can be considered as an example. When one postal matter 1 is taken out and blocks the optical axis of the sensor 11 and an output from the sensor 11 indicates "dark", the solenoid valve is turned ON (the solenoid valve is closed) so that the delivery operation is halted and the device stands by for taking-out of the next postal matter P. When the output from the sensor 11 indicates "bright" (no postal matter) or at the timing where a suitable gap is formed between the postal matters, the solenoid valve is turned OFF (the solenoid valve is opened), so that the next post matter is taken out.

In order to heighten the throughput, information in plural rows (or line sensor) of the sensors 11 are used as a control signal, and the acceleration/deacceleration of the take-out belt 23 and the turning on or off of the solenoid valve are repeated based on more definite and accurate position information about the postal matters P.

The take-out device 1 adopts the constitution such that the negative pressure is generated at the peripheral surface of the separating roller 31 and the separating torque in the opposite direction is applied so as to separate the multiply-fed postal matters. For this reason, a constant space is necessary between the take-out belt 23 and the separating roller 31. Ideally, this space is narrow to such an extent that when the two postal matters with comparatively small thickness, for example, are multiply fed, the negative pressure is sufficiently applied to the second postal matter from the separating roller 31, and the space is wide to such an extent that when a comparatively thick postal matter is sent or three or more postal matters are multiply fed, jam does not occur.

However, in order to securely separate the multiply-fed postal matters with comparatively thin thickness, the upper limit of the space is determined by necessity. When the space is widened excessively, the multiply-fed postal matters cannot be separated. Since the upper limit of the space is determined, it is more likely that jam occurs when the comparatively thick postal matter is sent. In the constitution of this embodiment, the take-out belt 23 opposed to the separating roller 31 is bent so that the space can be widened to a certain extent. However, when a postal matter whose thickness exceeds an allowable range is sent, jam occurs because the bending of the take-out belt 23 is limited.

For this reason, in this embodiment, the separating roller 31 is arranged fixedly to the conveyance path 10, and the take-out belt 23 is movable according to thicknesses of postal matters on a portion opposed to the separating roller 31. On the contrary, it can be considered that the separating roller 31 is movable in a direction separating from the conveyance path 10. However, when the separating roller 31 which separates the multiply-fed postal matters is separated from the conveyance path 10, a moment that the separating roller 31 does not interfere with the postal matters is generated, so that the separating function is not fulfilled for this moment. For this reason, in this embodiment, the take-out belt 23 can leave in a direction separating from the conveyance path 10.

Figure 19:
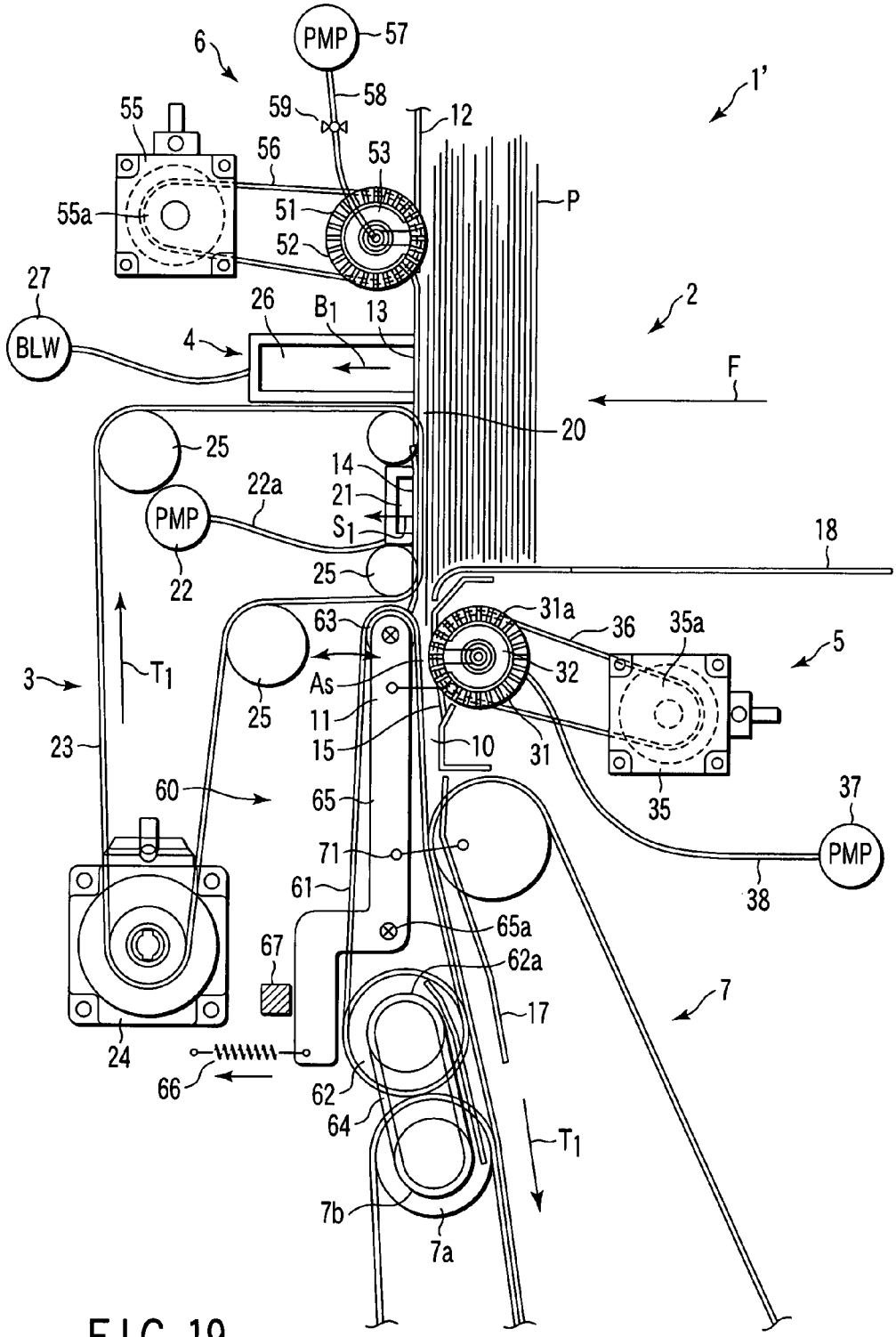
FIG. 19 is a plan view illustrating the take-out device in which a belt opposed to a separating area can be left in a direction separating from the conveyance path.
Figure 20:
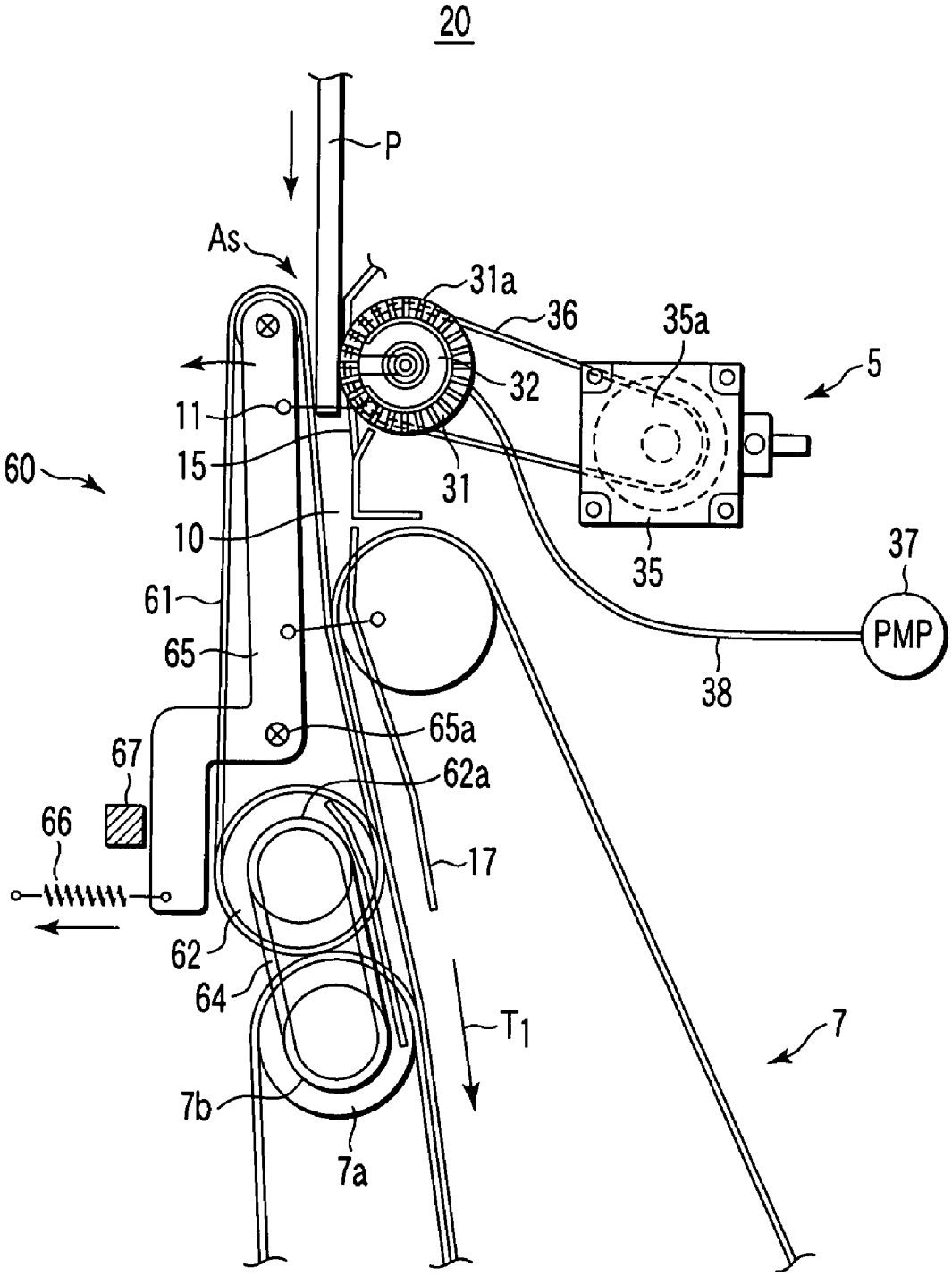
FIG. 20 is a partially enlarged plan view illustrating an enlarged main section of the take-out device in FIG. 19.

A space variable mechanism 60 in the separating area As will be described below with reference to FIGS. 19 and 20. FIG. 19 is a plan view illustrating a take-out device 1' having the space variable mechanism 60, and FIG. 20 is a partially enlarged plan view illustrating the operation of the space variable mechanism 60. The components which function similarly to those in the take-out device 1 are designated by the same reference numerals, and the detailed description thereof is omitted.

As shown in FIG. 19, the space variable mechanism 60 has a driving side roller 62 and an oscillating side roller 63 around which an endless movable belt 61 is wound and stretched. A driving force is transmitted from the conveyance mechanism 7 to the driving side roller 62 so as to rotate the roller 62. More specifically, an endless round belt 64 is wound around a pulley 62*a* provided to a rotating shaft of the driving roller 62 and a pulley 7*b* provided to a rotating shaft of a roller 7*a* in the conveyance mechanism 7, so that the rollers 62 and 7*a* are connected. The movable belt 61 runs in a direction of an arrow T1 at the same speed as that of the conveyance mechanism 7. On the other hand, the oscillating side roller 63 is rotatably mounted on a front end of an oscillating arm 65 that oscillates in a direction of an arrow Y in the drawing about a rotating shaft 65*a*. The roller 63 is movably arranged on a position where it is roughly across the conveyance path 10 from the separating roller 31.

A tension spring 66 stretches to be installed at a proximal end of the oscillating arm 65, and the oscillating arm 65 is always biased in a counterclockwise direction about the rotating shaft 65*a*. A stopper 67 which halts the rotation of the oscillating arm 65 on a constant position against a biasing force of the tension spring 66 is provided near the proximal end of the oscillating arm 65. The stopper 67 regulates the rotation of the oscillating arm 65 in the clockwise direction such that the oscillating side roller 63 mounted on the front end of the oscillating arm 65 is prevented from exceeding a certain distance to reach the separating roller 31. That is, the position of the stopper 67 determines a distance between the separating roller 31 and the oscillating side roller 63, namely, a space between the separating roller 31 and the movable belt 61 in the separating area As.

In FIG. 20, a comparatively thick and heavy postal matter P is taken out from the take-out position 20 and a front end of the postal matter P in the take-out direction is sent between the separating roller 31 and the movable belt 61 (oscillating side roller 63). At this time, the space movable mechanism 60 is operated and the oscillating arm 65 is oscillated in the counterclockwise direction in the drawing. The front end of the movable belt 61 is oscillated in the direction being separated from the conveyance path 10 to leave. Specifically, the front end of the postal matter P to which the conveyance force has been applied by the take-out belt 32 collides with the movable belt 61. At this time, when the postal matter P is thick and heavy, the movable belt 61 is pushed by the postal matter P so as to be oscillated in the direction being separated from the conveyance path 10. Consequently, even when the comparatively thick and heavy postal matter P is taken out, the space between the separating roller 31 and the movable belt 61 is widened, thereby preventing the postal matter P from blocking the space and generation of jam. This makes it possible to prevent a failure such that an operating rate of the device is degraded due to the jam process.

In this case, the comparatively thick and heavy postal matter P itself has the sufficient conveyance force. Therefore, even when the movable belt 61, which applies the conveyance force to the postal matter P after taking-out from the take-out position 20, is separated from the conveyance path 10, the postal matter P is conveyed to the downstream side without any problem by its inertial force. In this case, even if second and subsequent multiply-fed postal matters are carried along with the comparatively thick and heavy postal matter P, the separating roller 31 fixed to the conveyance path 10 normally functions, and thus, its separating ability is not degraded.

On the other hand, although not shown here, when a comparatively thin and light postal matter P is taken out from the take-out position 20, the movable belt 61 does not oscillate even if the postal matter P collides with the movable belt 61. The space between the separating roller 31 and the movable belt 61 maintains its initial size. In other words, a spring constant of the tension spring 66 is set so that even if the thin and light postal matter P which hardly causes jam collides with the movable belt 61, the oscillating arm 65 does not move. For this reason, when the comparatively thin and light postal matter P is sent to the separating area As, it can be processed without any problem regardless of multiple feeding.

When the movable belt 61 is used as the conveyance belt opposed to the separating area As like this embodiment, the position where the stopper 67 is mounted is adjusted, so that the space between the separating roller 31 and the movable belt 61 can be set to a suitable value. As a result, the separating ability for the thin and light multiply-fed postal matters P can be heightened. Further, when the comparatively thick and heavy postal matters P are taken out, they can be normally processed without causing jam.

In the case where the space variable mechanism 60 is provided or not, the possibility of jam occurrence is not completely exhausted in the separating area As between the separating roller 31 and the take-out belt 23 (or the movable belt 61). The separating roller 31 basically applies the separating torque in the direction opposite to the take-out direction of the postal matter P. For example, in the case where the deposited postal matter P is bent or stapled, jam occasionally occurs regardless of the presence/non-presence of the space variable mechanism 60.

In this embodiment, such cases are assumed, and jammed postal matters P are forcibly discharged. Specifically, the postal matter P taken out from the take-out position 20 is delivered to the conveyance mechanism 7 to be drawn out and conveyed. For this reason, no jam can be determined when after a constant time has passed after the taking-out, the postal matter P is delivered to the conveyance mechanism 7. In other words, the postal matter P, which is not delivered to the conveyance mechanism 7 after the constant time has passed after the taking-out, can be determined as a jammed postal matter P. That is, when the postal matter P does not block an optical axis of a sensor 71 arranged at an inlet of the conveyance mechanism 7 after the constant time has passed, the jam of the postal matter P is determined.

In this case, in order to discharge the jammed postal matter P, a conveyance force in the forward direction stronger than normal one should be applied to the postal matter P in the separating area As where the postal matter P is probably jammed. Since the movable belt 61 opposed to the separating area As runs by being applied with the driving force from the conveyance mechanism 7, it is difficult to change the running speed and the torque. In this embodiment, in such a case, the separating roller 31 opposed to the separating area As is driven by an exceptional operation different from the normal operation.

That is, when the postal matter P jammed in the separating area As is forcibly discharged, the separating roller 31 is rotated in the forward direction (the direction of the arrow T1), and a rotating torque stronger than normal one is applied. In this case, the negative pressure to be applied to the peripheral surface of the separating roller 31 is heightened, so that the drawing force of the separating roller 31 to be applied to the postal matter P is increased. As a result, the postal matter P is held firmly to the peripheral surface of the separating roller 31.

When the jammed postal matter P is forcibly discharged by the normal process in such a manner, the time and the number of times of stopping the device for the jam process can be reduced. As a result, the operating rate of the device can be heightened. Since the forcibly discharged postal matter P cannot be directly processed, it is discharged via the gate G1 to the reject section 104 on the downstream side.

Figure 21:
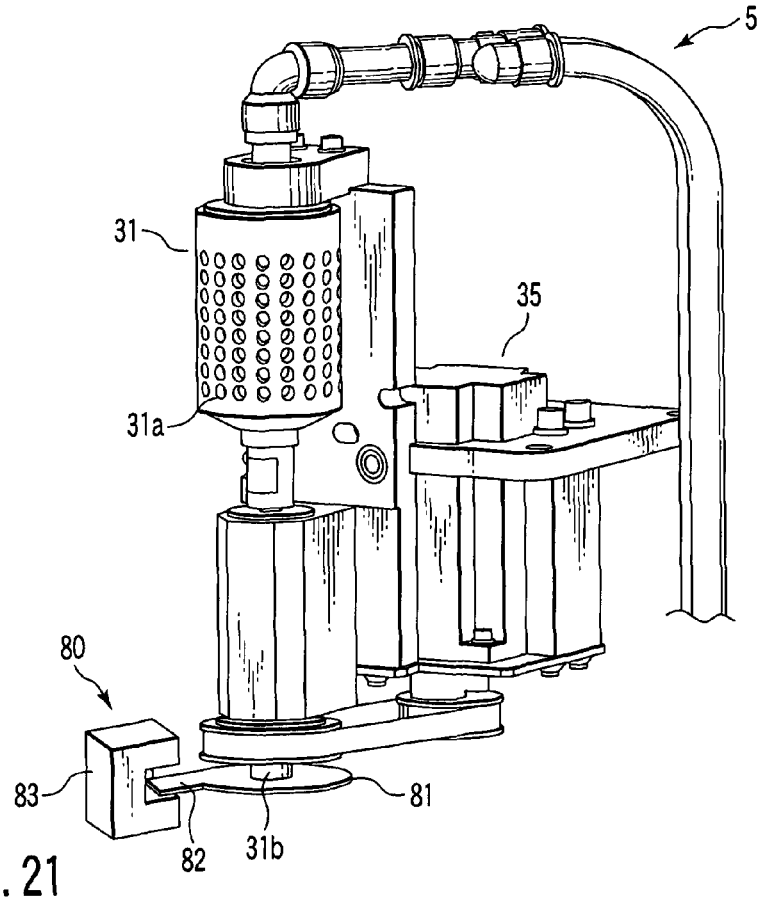
FIG. 21 is a schematic perspective view illustrating the separating mechanism of the take-out device in FIG. 19.

FIG. 21 is a schematic perspective view illustrating a main section of the separating mechanism 5. The separating mechanism 5 has the separating roller 31 having many adsorption holes 31*a* opened on its outer peripheral surface. As shown in FIG. 21, as to the adsorption holes 31*a* of the separating roller 31 in this embodiment, the rows arranged in the axial direction of the roller are formed by a pattern such that a plurality of rows are arranged along its rotating direction. That is, the separating roller 31 is rotated at a constant speed so that the negative pressure is generated on the peripheral surface via the adsorption holes 31*a*. In this case, the peripheral surface of the separating roller 31 applies the negative pressure to the opposed conveyance path 10 intermittently.

Figure 22:
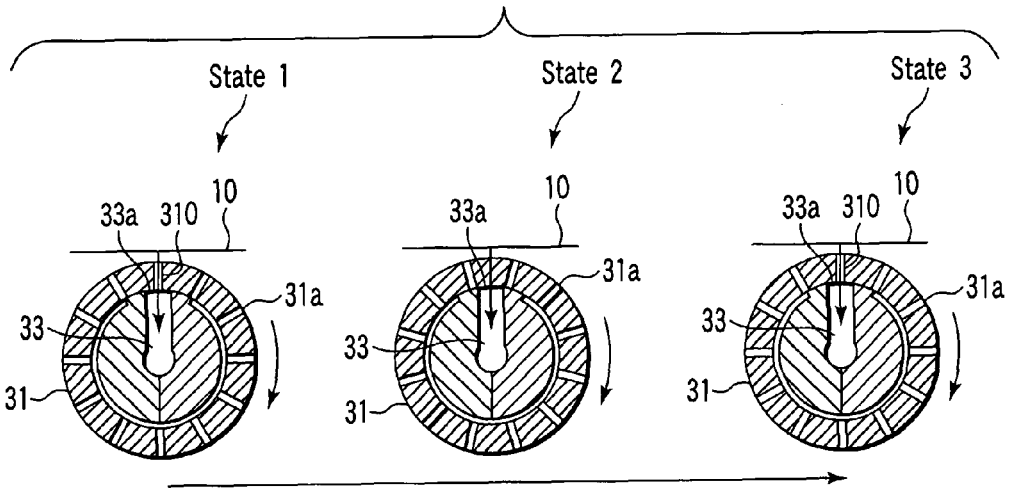
FIG. 22 is an operation explanatory diagram illustrating a rotating state of the separating roller.
Figure 23:
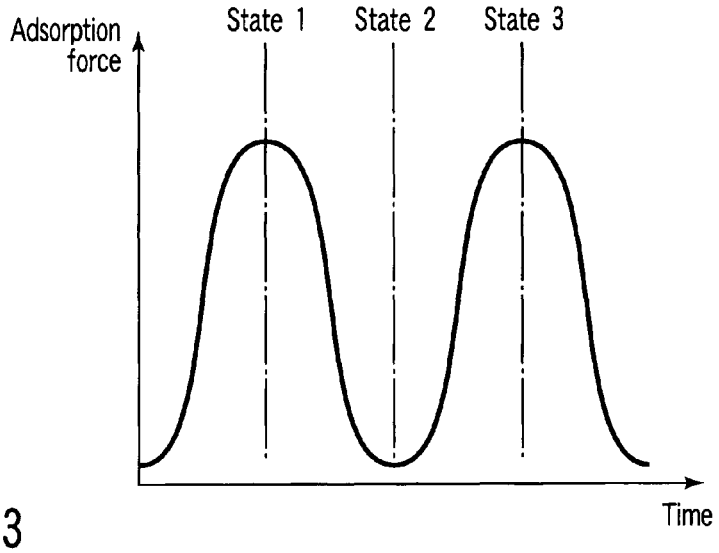
FIG. 23 is a graph illustrating a negative pressure in the respective states of FIG. 22.

More specifically, as shown in FIG. 22, the separating roller 31 is arranged fixedly so that the opening 33*a* of the chamber 33 is opposed to the conveyance path 10. When the separating roller 31 is rotated in the direction of an arrow, the adsorption holes 31*a* are brought into two states alternately. In one state, the adsorption holes 31*a* are opposed to the conveyance path 10 so as to be connected with the opening 33*a* of the chamber 33. In the other state, the adsorption holes 31*a* are not opposed to the conveyance path 10 and are not connected with the opening 33*a* of the chamber 33. For this reason, the negative pressure to be applied from the peripheral surface of the rotating separating roller 31 to the conveyance path 10 (namely, the postal matter P conveyed through the conveyance path 10), namely, the adsorption force of the separating roller 31 changes in an oscillating manner according to the rotation of the separating roller 31 as shown in a graph of FIG. 23.

In a precise sense, since the adsorption force for adsorbing the postal matters P is generated intermittently on the peripheral surface of the separating roller 31, a sufficient negative pressure cannot be applied to the postal matter P for one moment according to the rotating position of the separating roller 31. For this reason, for example, the negative pressure is eliminated at the timing where the rotating direction of the separating roller 31 is switched or the timing where the operation of the separating roller 31 is started, the timing of the separating control is off or the separating ability is degraded.

In this embodiment, as shown in FIG. 21, a detecting device 80 for detecting the rotating position of the separating roller 31 is mounted on the separating mechanism 5 so as to be capable of detecting two states. In one state, the adsorption holes 31*a* of the separating roller 31 (namely, specified adsorption holes 310) are opposed to the conveyance path 10 (for example, states 1 and 3 in FIG. 22; hereinafter, such states are called an adsorption state). In the other state, the adsorption holes 31*a* of the separating roller 31 are not opposed to the conveyance path 10 (for example, a state 2 in FIG. 22; such a state is called a non-adsorption state). The rotation of the separating roller 31 (AC servo motor 35) is controlled based on the detected result such that two postures are consciously achieved. In one posture, the specified adsorption holes 310 are opposed to the conveyance path 10. In the other posture, the specified adsorption holes 310 are not opposed to the conveyance path 10.

For example, the detecting device 80 detects a claw 82 of a rotating disc 81 mounted on the rotating shaft 31*b* (see FIG. 7) of the separating roller 31 by means of a photo-interrupter 83, and acquires operating information of the AC servo motor 35. As a result, the rotating position of the separating roller 31 can be detected with high accuracy. The detecting device 80 can detect the rotating position of the separating roller 31 with high accuracy by adopting the absolute type of the AC servo motor 35.

The separating mechanism 5 having the separating roller 31 with the above constitution processes the postal matters passing through the separating area As normally and stably. In order to attain this process, some effective control methods are considered. Some effective control methods for the separating mechanism 5 are described below as examples.

Figure 24:
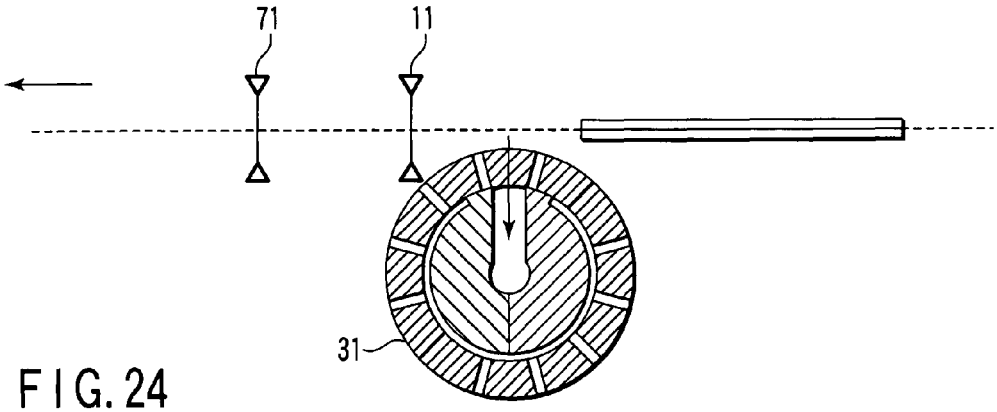
FIG. 24 is an operation explanatory diagram illustrating the first control operation of the separating roller.

In the first control method, at the time of a non-separating operation (a state shown in FIG. 24) before the postal matter P taken out from the take-out position 20 is sent to the separating area As, the separating roller 31 is rotated into the non-adsorption state where its specified adsorption holes 310 are not opposed to the conveyance path 10 and is halted. In this state, the peripheral surface of the separating roller 31 has vary little negative pressure in the separating area As where it is opposed to the conveyance path 10. Further, since the adsorption force of the separating roller 31 is also very little, the postal matter P is conveyed without receiving resistance from the separating roller 31.

Figure 25:
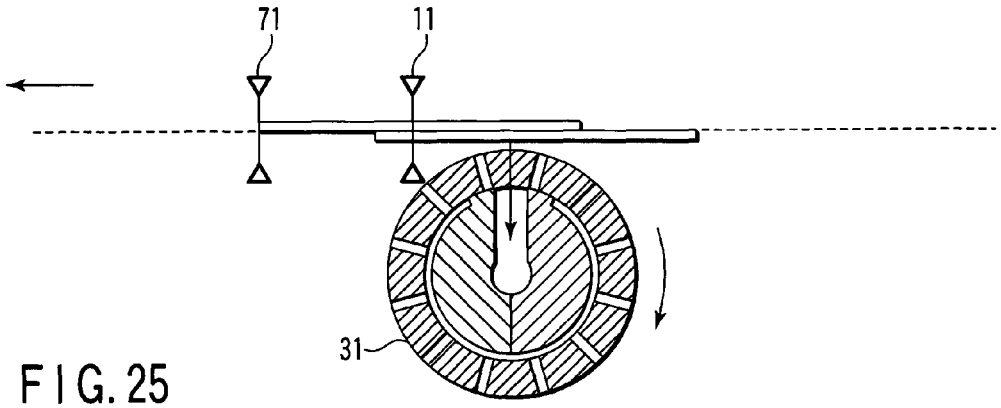
FIG. 25 is an operation explanatory diagram illustrating the first control operation of the separating roller
Figure 26:
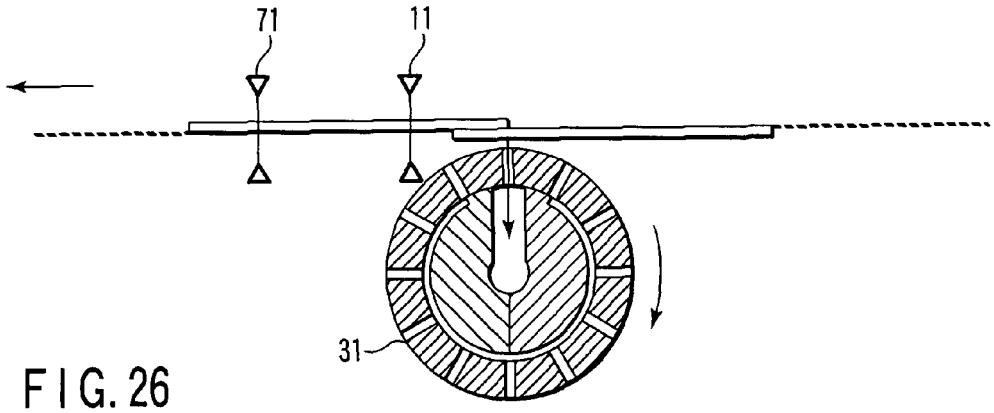
FIG. 26 is an operation explanatory diagram illustrating the first control operation of the separating roller.

The front end of the postal matter P is delivered to the conveyance mechanism 7 and the optical axis of the sensor 71 is blocked by the postal matter P. This state (state shown in FIG. 25) triggers the application of the separating torque in the opposite direction to the separating roller 31, so that the separating operation is started (state shown in FIG. 26). At this time, the separating roller 31 starts to operate from the state that it is in the non-adsorption state, namely, is halted. For this reason, the separating roller 31 can be operated at the same timing every time, and thus dispersion of the separating timing can be eliminated.

Figure 27:
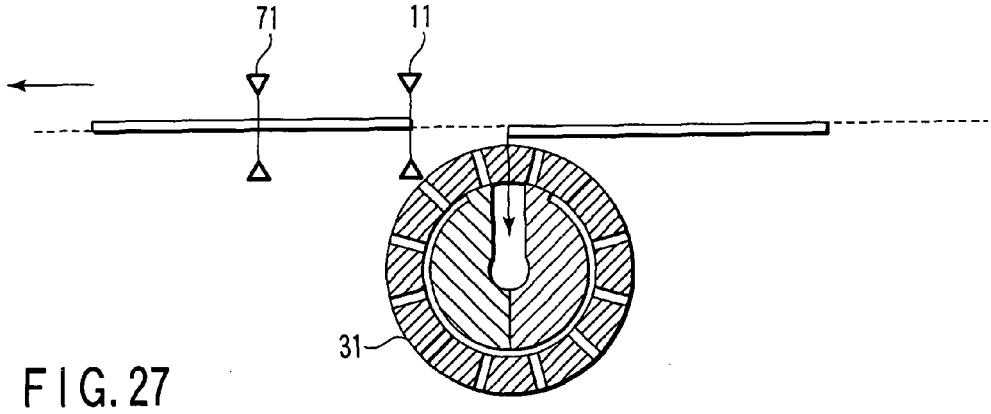
FIG. 27 is an operation explanatory diagram illustrating the first control operation of the separating roller.

The output from the sensor 11 indicating "dark" is changed into the output indicating "bright", and the separating operation is ended. Thereafter, as shown in FIG. 27, the separating roller 31 is rotated into the non-adsorption state to be halted, and is returned to the standby state shown in FIG. 24.

A series of the rotating control of the separating roller 31 can make the timing of starting the separating operation always equal. The timing of the separating control can be constant, and the separating ability can be prevented from being degraded.

Figure 28:
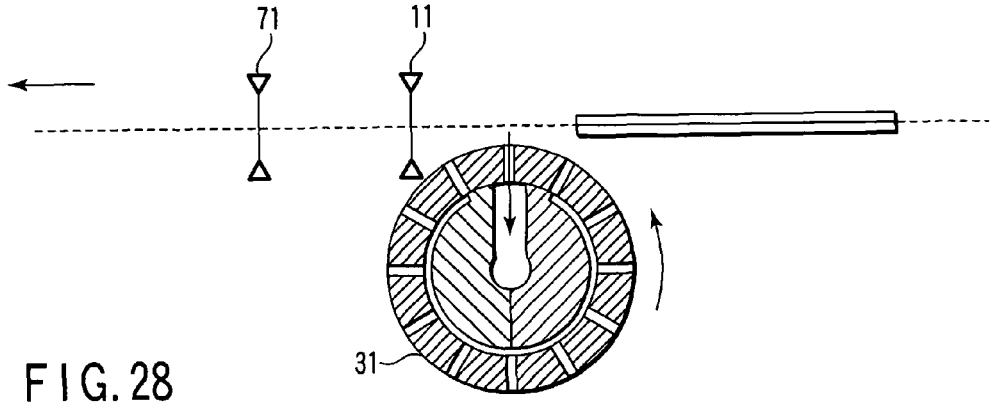
FIG. 28 is an operation explanatory diagram illustrating the second control operation of the separating roller.

In the second control method, at the time of the non-separating operation before the postal matter P taken out from the take-out position 20 is sent to the separating area As (state shown in FIG. 28), the separating roller 31 is rotated in the forward direction for a short time at the same speed as that of the take-out belt 23. In such a manner, the conveyance of the postal matter P is assisted for a short time by the separating roller 31.

Figure 29:
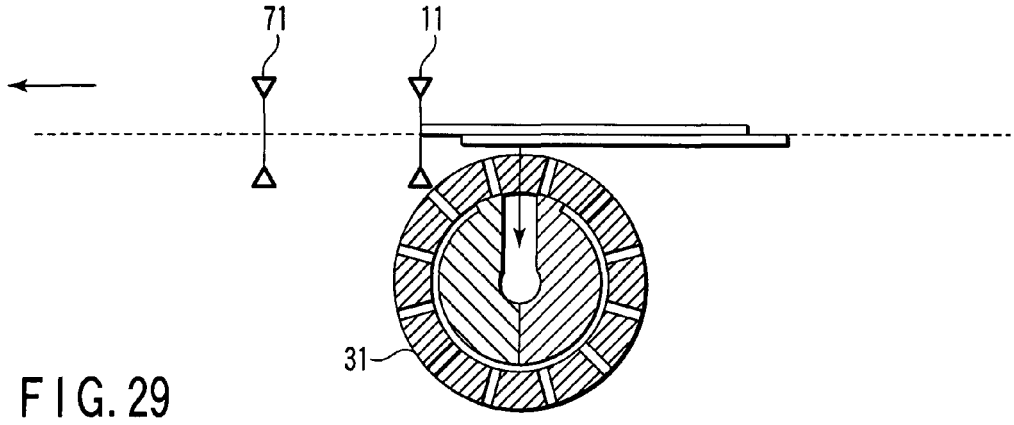
FIG. 29 is an operation explanatory diagram illustrating the second control operation of the separating roller.

Thereafter, the blocking of the optical axis of the sensor 11 by the front end of the postal matter P (state shown in FIG. 29) triggers the rotation of the separating roller 31 into the non-adsorption state and the roller 31 is halted. In this state, very little negative pressure is applied to the postal matter P to be conveyed through the conveyance path 10, and the postal matter P is conveyed depending on the conveyance force of the take-out belt 23. Similarly to FIG. 24, as might be expected, the postal matter P does not receive the resistance from the separating roller 31.

Figure 30:
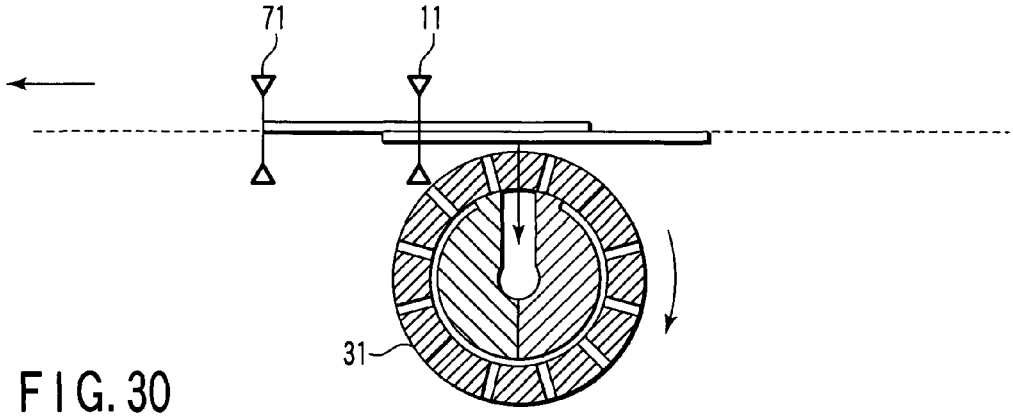
FIG. 30 is an operation explanatory diagram illustrating the second control operation of the separating roller.
Figure 31:
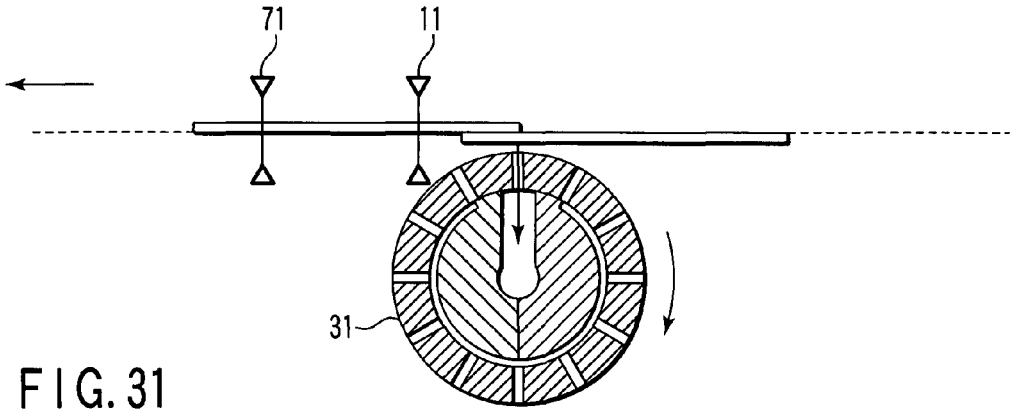
FIG. 31 is an operation explanatory diagram illustrating the second control operation of the separating roller.

The fact that the front end of the postal matter P to be conveyed through the conveyance path 10 has passed through the optical axis of the sensor 71 (state shown in FIG. 30) triggers the application of the separating torque in the opposite direction to the separating roller 31, so that the separating operation is started (state shown in FIG. 31). At this time, the separating roller 31 starts to operate from the state that it is in the non-adsorption state, namely, is halted (states shown in FIGS. 29 and 30). For this reason, the separating roller 31 can be operated at the same timing every time, and thus the dispersion of the separating timing can be eliminated.

Figure 32:
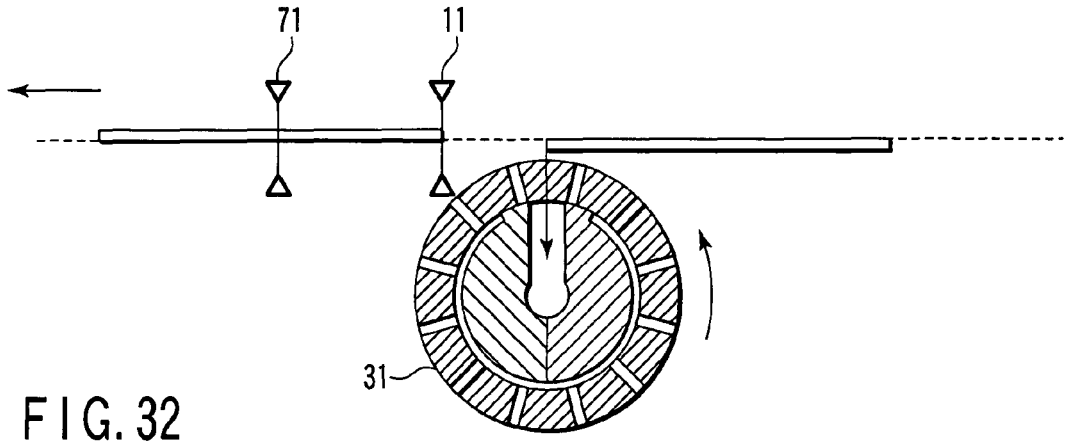
FIG. 32 is an operation explanatory diagram illustrating the second control operation of the separating roller.

Further, the output indicating "dark" from the sensor 11 is changed to the output indicating "bright", and the separating operation is ended. As shown in FIG. 32, the separating roller 31 is again rotated in the forward direction so as to be returned to the standby state of FIG. 28.

The series of the rotation control of the separating roller 31 enables the separating operation timing to be set uniformly and thus makes the separating control timing constant. As a result, the deterioration of the separating ability can be prevented. Adoption of the second control method allows the separating roller 31 to be rotated in the forward direction to assist the conveyance of the postal matter P only for a short time in the standby state in FIG. 28.

Figure 33:
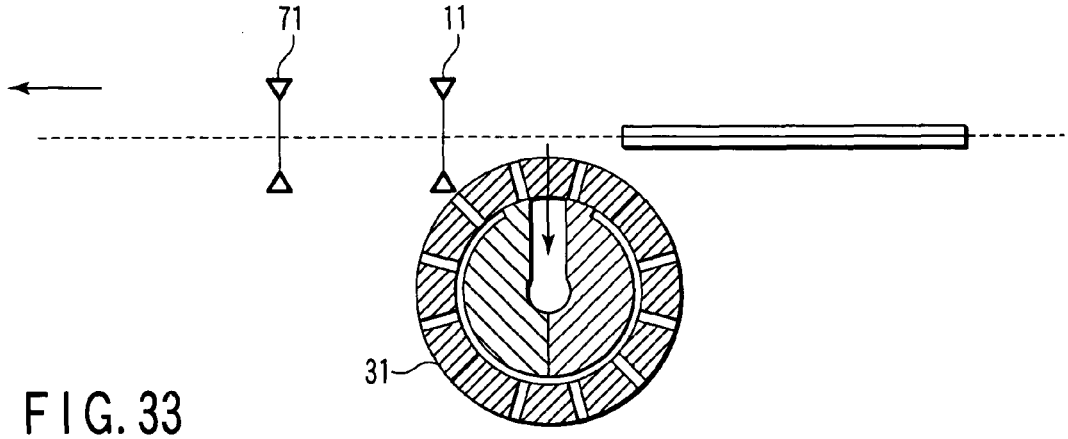
FIG. 33 is an operation explanatory diagram illustrating the third control operation of the separating roller.
Figure 38:
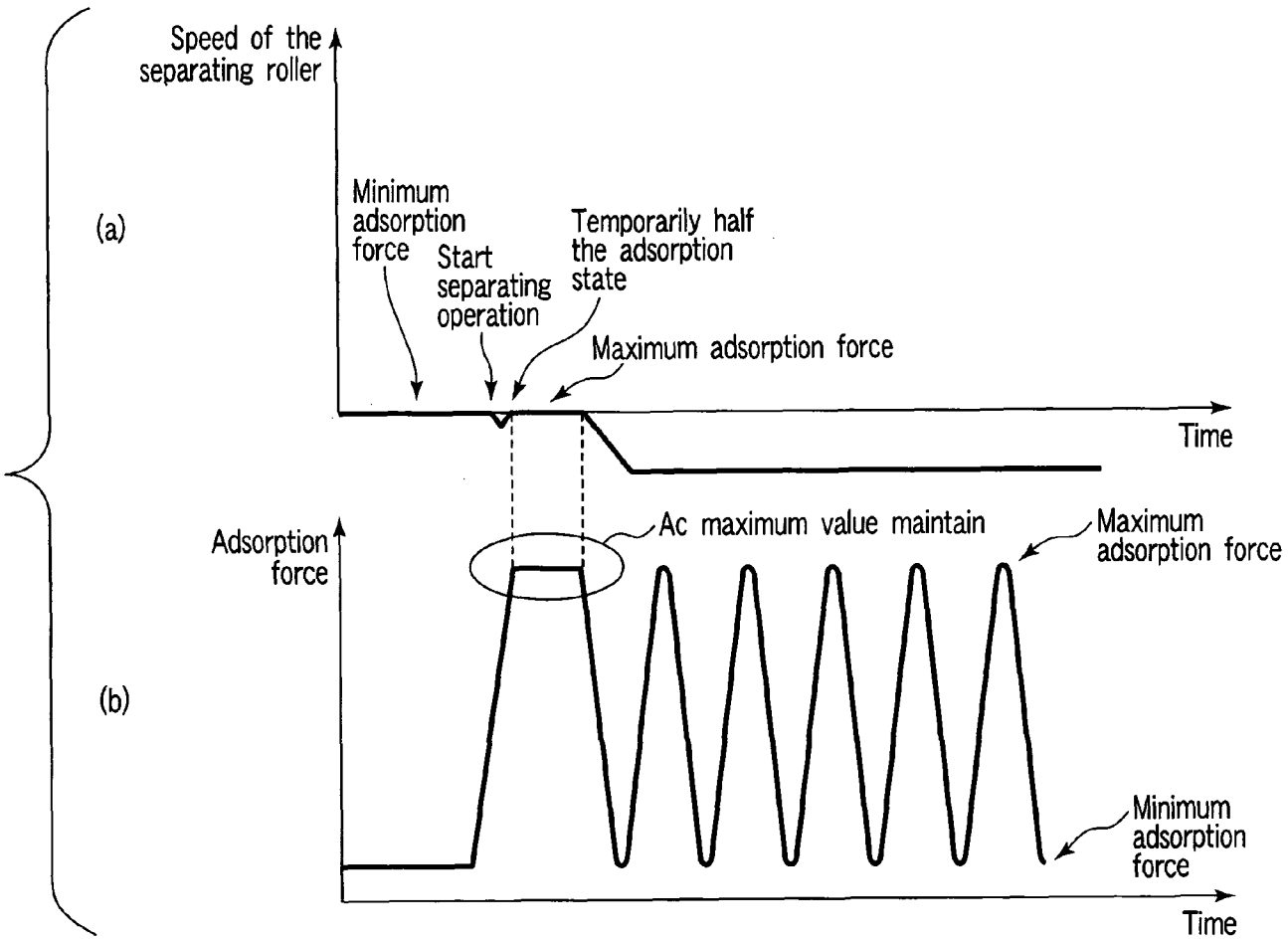
FIG. 38 is a graph illustrating a temporal change in a speed (a) and a temporal change in the negative pressure (b) of the separating roller.

In the third control method, similarly to the first control method, at the time of the non-separating operation before the postal matter P taken out from the take-out position 20 is sent to the separating area As (state shown in FIG. 33), the separating roller 31 is rotated into the non-adsorption state to be halted such that the specified adsorption holes 310 are not opposed to the conveyance path 10. In this state, the peripheral surface of the separating roller 31 has very little negative pressure in the separating area As where it is opposed to the conveyance path 10, and very little adsorption force by means of the separating roller 31 is present (FIG. 38; minimum adsorption force).

Figure 34:
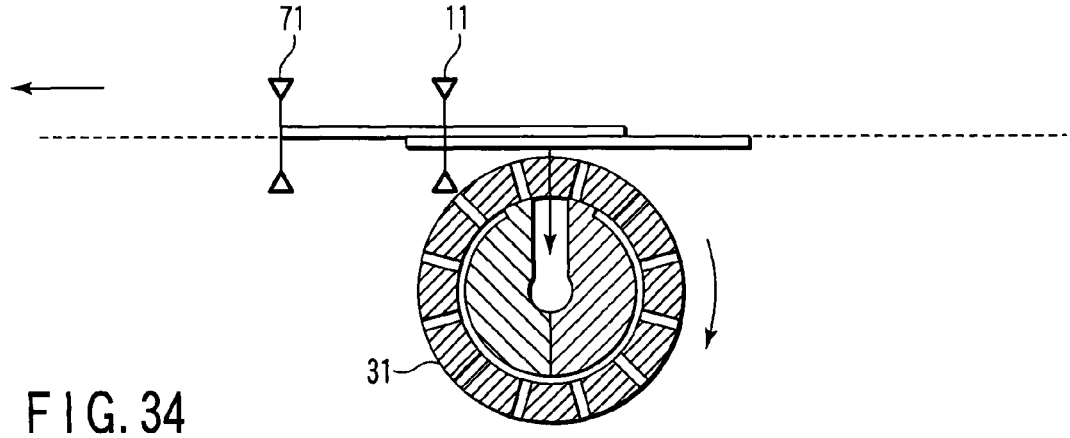
FIG. 34 is an operation explanatory diagram illustrating the third control operation of the separating roller.

Thereafter, the front end of the postal matter P is delivered to the conveyance mechanism 7, and the optical axis of the sensor 71 is blocked by the postal matter P (state shown in FIG. 34). This triggers the separating torque in the opposite direction to be applied to the separating roller 31, so that the separating operation is started.

Figure 35:
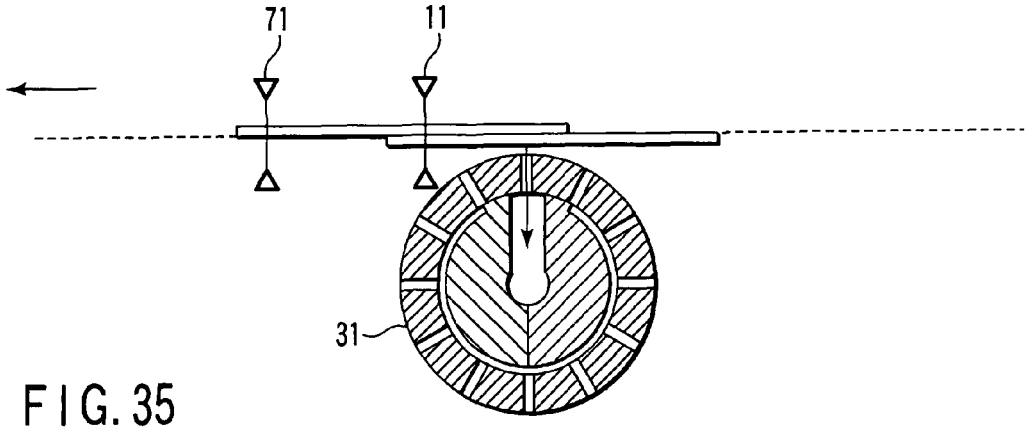
FIG. 35 is an operation explanatory diagram illustrating the third control operation of the separating roller.
Figure 36:
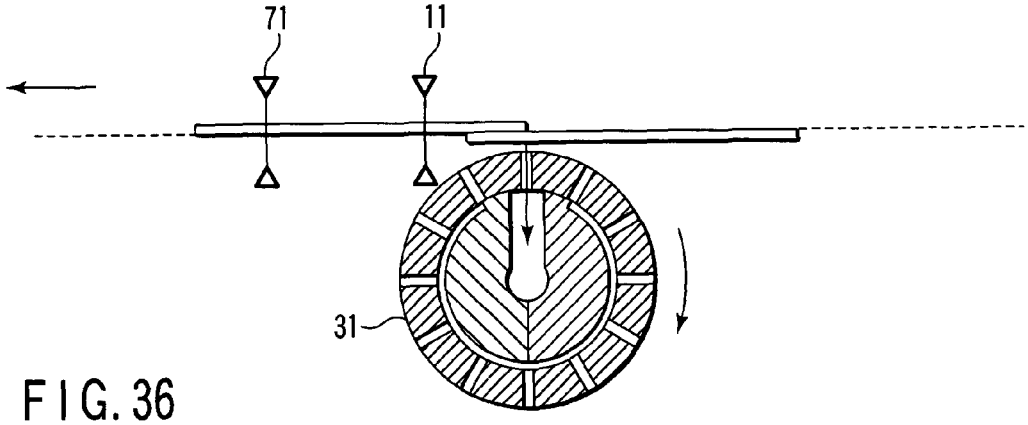
FIG. 36 is an operation explanatory diagram illustrating the third control operation of the separating roller.

Immediately after the separating operation is started, as shown in FIG. 35, the separating roller 31 is rotated to be halted in the adsorption state where its adsorption holes 31*a* are opposed to the conveyance path 10. The negative pressure is sufficiently applied to the postal matter P to be conveyed through the conveyance path 10, so that the postal matter P is firmly adsorbed to the peripheral surface of the separating roller 31 (FIG. 38; maximum value maintains). In this case, immediately after the separating operation is started, the separating torque in the opposite direction is not applied to the separating roller 31, but the separating roller 31 is temporarily halted in the adsorption state, so that the negative pressure is applied securely to the postal matter P. Consequently, as shown in FIG. 36, the second postal matter P to be separated can be caught by the peripheral surface of the separating roller 31, so as to be securely separated.

Figure 37:
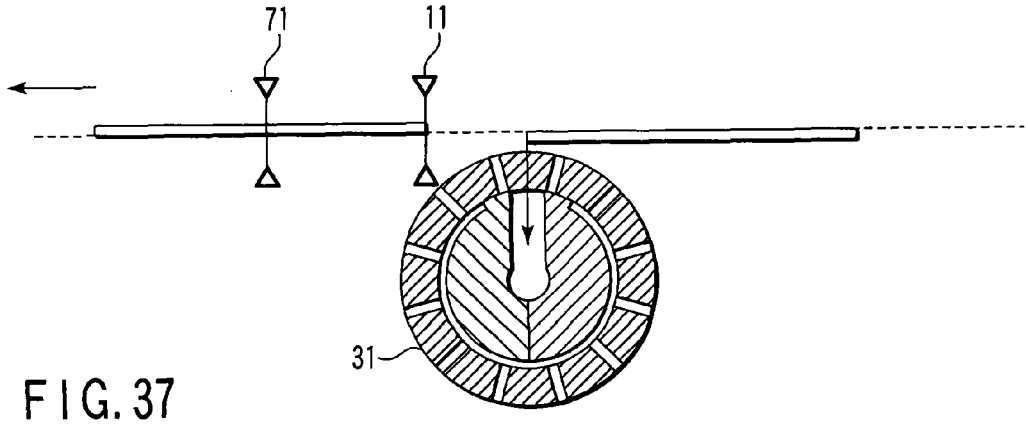
FIG. 37 is an operation explanatory diagram illustrating the third control operation of the separating roller.

The output from the sensor 11 is changed from "dark" to "bright", and the separating operation is ended. Thereafter, as shown in FIG. 37, the separating roller 31 is rotated to be halted in the non-adsorption state so as to be returned to the standby state of FIG. 33.

According to the series of the rotation control of the separating roller 31, particularly, when the separating roller 31 is rotated to be temporarily halted in the adsorption state immediately after the separating operation is started as shown in FIG. 35, the postal matters P to be separated can be firmly adsorbed to the separating roller 31 in the area Ac where the maximum value of the negative pressure is maintained shown in FIG. 38. As a result, the separating operation can be further ensured.

In this embodiment adopting the first to third control methods, the pattern of the adsorption holes 31*a* is designed so that the negative pressure of the separating roller 31 is generated intermittently. However, it can be considered that the adsorption holes 31 are formed into a pattern such that the negative pressure can be generated continuously on the peripheral surface of the separating roller 31 while it is rotating.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

For example, in the above embodiment, the vacuum pumps 22, 37 and 57 are provided to the take-out mechanism 3, the separating mechanism 5 and the auxiliary mechanism 6, respectively. However, the constitution is not limited to this, and a plurality of wirings may be connected to one vacuum pump, so that the respective solenoid valves are controlled to be opened and closed individually.

In the above embodiment, the negative pressure is generated on the peripheral surface of the separating roller 31, so that the separating torque is applied thereto. In another method, the negative pressure is generated on the peripheral surface of the auxiliary roller 51, so that the rotation is controlled. However, the constitution is not limited to this, and an endless belt may be used instead of the roller.

What is claimed is:

1. A paper sheet separating and take-out device comprising:

a deposit section in which a plurality of overlapped paper sheets are deposited;

a supply mechanism which moves said plurality of deposited paper sheets in an overlapping direction so as to supply a paper sheet at a front end of a moving direction to a take-out position at one end of the deposit section;

a take-out mechanism which comes in contact with the paper sheet supplied to the take-out position and rotates so as to take out the paper sheet in a direction substantially perpendicular to the overlapping direction;

a separating mechanism which is fixedly arranged to a side opposite to the take-out mechanism across a conveyance path for conveying the paper sheets on a downstream side of a take-out direction of the paper sheets by the take-out mechanism, the separating mechanism applies a negative pressure to the paper sheets to be taken out onto the conveyance path and simultaneously applies a separating torque in an opposite direction to the take-out direction, so as to separate second and subsequent paper sheets that are carried along with the paper sheet to be taken out from the take-out position; and a space variable mechanism which is arranged to regulate one side of the conveyance path and is positioned opposite to the separating mechanism, the space variable mechanism is configured to move in a direction in which it separates away from the conveyance path, due to a collision of the paper sheet taken out onto the conveyance path by the take-out mechanism, so as to increase a space with respect to the separating mechanism, wherein the space variable mechanism includes a movable belt which oscillates due to the collision of the paper sheets to be conveyed via the conveyance path and applies a conveyance force to the paper sheet taken out onto the conveyance path.

2. The paper sheet separating and take-out device according to claim 1, wherein in the case where a paper sheet is jammed between the separating mechanism and the movable belt, the separating mechanism is rotated forward in the take-out direction so as to discharge the jammed paper sheet.

3. The paper sheet separating and take-out device according to claim 2, wherein when the jammed paper sheet is discharged, the negative pressure to be applied to the paper sheet from the separating mechanism is increased.

* * * * *